US010857446B2

(12) United States Patent
Hassenboehler, Jr.

(10) Patent No.: US 10,857,446 B2
(45) Date of Patent: Dec. 8, 2020

(54) CUE SPORT AIMING APPARATUS AND METHOD OF USE

(71) Applicant: Charles Hassenboehler, Jr., Knoxville, TN (US)

(72) Inventor: Charles Hassenboehler, Jr., Knoxville, TN (US)

( * ) Notice: Subject to any disclaimer, the term of this patent is extended or adjusted under 35 U.S.C. 154(b) by 0 days.

(21) Appl. No.: 15/856,943

(22) Filed: Dec. 28, 2017

(65) Prior Publication Data

US 2019/0134490 A1 May 9, 2019

Related U.S. Application Data

(63) Continuation-in-part of application No. 15/803,191, filed on Nov. 3, 2017, now abandoned.

(51) Int. Cl.
*A63D 15/00* (2006.01)
*A63D 15/10* (2006.01)

(52) U.S. Cl.
CPC ..... *A63D 15/006* (2013.01); *A63D 15/105* (2013.01)

(58) Field of Classification Search
CPC .... A63B 2243/00; A63B 69/00; A63D 15/00; A63D 15/006; A63D 15/08–12
USPC ..... 473/1, 2, 42, 44–51
See application file for complete search history.

(56) References Cited

U.S. PATENT DOCUMENTS 1,943,066 A * 1/1934 Ford ..... A63B 53/06 473/239
3,372,929 A * 3/1968 Molis ..... A63D 15/105 473/43
3,389,911 A * 6/1968 Castiglione, Jr. .... A63D 15/006 33/263
3,411,779 A * 11/1968 McGowan ..... A63D 15/006 473/2
3,711,091 A 1/1973 Dixon
3,947,026 A 3/1976 Scoutten
4,151,990 A 5/1979 Josehans
4,268,033 A 5/1981 Fontaine
(Continued)

FOREIGN PATENT DOCUMENTS

GB 2148134 A * 5/1985 ..... A63D 15/105
GB 2162074 A * 1/1986 ..... A63D 15/006
(Continued)

OTHER PUBLICATIONS

Viking A681 Birdseye Mirror 4 Point Pool Cue, http://www.seyberts.com:80/products/Viking_A681_Birdseye_Mirror_4_Point_Pool_Cue-104757-10442.html, captured Feb. 2, 2015.*
(Continued)

*Primary Examiner* — Laura Davison
(74) *Attorney, Agent, or Firm* — Merchant & Gould P.C.

(57) ABSTRACT

An apparatus and method of use for assisting in ghost ball aiming are provided herein for use in cue sports. The apparatus enables a player to align an object ball with a target and determine an aim line at which to propel a cue ball to send the object ball to the target. The apparatus is selectively engaged or selectively attached to a cue stick to provide a visual indication of the aim line along the length of the cue stick. A pivot point of the apparatus is placed in contact with the play surface and secures an absolute position on the play surface as the cue stick and apparatus are rotated from a target line to the aim line.

16 Claims, 25 Drawing Sheets

(56) References Cited

U.S. PATENT DOCUMENTS

| | | | | | |
|---|---|---|---|---|---|
| 5,554,075 | A * | 9/1996 | Glazer | A63D 15/006 | 473/2 |
| 5,558,584 | A * | 9/1996 | Brown | A63D 15/08 | 473/44 |
| 5,645,490 | A * | 7/1997 | Lodrick | A63D 15/105 | 473/42 |
| 5,853,333 | A * | 12/1998 | Patterson | A63D 15/105 | 473/42 |
| 6,045,450 | A | 4/2000 | Cyr | | |
| 6,343,995 | B1 * | 2/2002 | Green, Jr. | A63D 15/105 | 473/43 |
| 6,527,647 | B2 | 3/2003 | Ringeisen | | |
| 6,699,136 | B2 * | 3/2004 | Kuo | A63D 15/006 | 473/2 |
| 6,783,462 | B1 * | 8/2004 | Costain | A63D 15/08 | 473/44 |
| 6,890,264 | B2 * | 5/2005 | Verona | A63D 15/12 | 473/49 |
| 7,040,996 | B2 * | 5/2006 | Grandin | A63D 15/08 | 473/46 |
| 8,870,669 | B1 * | 10/2014 | Griffin | A63D 15/105 | 473/42 |
| 9,044,666 | B2 * | 6/2015 | Cameron | A63D 15/006 | |
| 9,144,731 | B1 * | 9/2015 | Brooks | A63D 15/105 | |
| 2006/0030418 | A1 * | 2/2006 | Evans | A63D 15/08 | 473/44 |
| 2006/0189397 | A1 | 8/2006 | Tucker | | |
| 2009/0258718 | A1 * | 10/2009 | Cyr | A63D 15/006 | 473/2 |
| 2011/0070959 | A1 * | 3/2011 | Wylie | A63D 15/105 | 473/2 |
| 2013/0252750 | A1 * | 9/2013 | Cook, Jr. | A63D 15/105 | 473/42 |
| 2016/0144254 | A1 * | 5/2016 | Feeney | A63B 69/3685 | 473/2 |

FOREIGN PATENT DOCUMENTS

| | | | | |
|---|---|---|---|---|
| GB | 2335606 | A * | 9/1999 | A63D 15/006 |
| WO | WO 2004041376 | A1 * | 5/2004 | A63D 15/12 |

OTHER PUBLICATIONS

Chictopia, Single Stud Spike Ring, http://www.chictopia.com/photo/show/559833-Single+Stud+Spike+Ring-silver-ring, available online Jan. 4, 2012, (Year: 2012).*

Official International Ring Size Conversion Chart, http://ringsizes.co/, archived Mar. 31, 2013 (Year: 2013).*

"New McDermott Ghostball Aim Trainer—Pool/Billiard Training Aid" Retrieved from https://www.ebay.com/310919167022?chn=ps, accessed Jan. 10, 2019.

"New Elephant Ghostball Aim Trainer" Retrieved from http://vi.raptor.ebaydesc.com/ws/eBayISAPI.dll?ViewItemDescV4&item=310919167022&category=75193&pm=1&ds=0&t=1546014040000&ver=0. Accessed Jan. 10, 2019.

"Ghost Ball Aim Trainer" Retrieved from https://www.brunswickbilliards.com/gifts-and-accessories/ghost-ball-aim-trainer. Accessed Jan. 10, 2019.

* cited by examiner

500

CUE SPORT AIMING APPARATUS AND METHOD OF USE

CROSS REFERENCE TO RELATED APPLICATIONS

The present application is a continuation-in-part of U.S. patent application Ser. No. 15/803,191 filed on Nov. 3, 2017 with the title "Cue Sport Aiming Apparatus and Method of Use", which is hereby incorporated by reference in its entirety.

INTRODUCTION

Cue sports are popular games of skill and finesse that require the players to understand force, angles, spin, and the transfer of momentum to successfully complete the objectives of the games. Most cue sports require the player to use a cue stick to strike a cue ball, which in turn is struck into one or more play balls (also referred to as an object ball when it is the first target for the cue ball to strike) and transfers its momentum to the play balls to direct them across the play surface. Object balls are often aimed into targets including other play balls, bumpers/caroms, or towards pockets according to the objectives of the game and the individual players' strategies. As games of skill, however, newer players often struggle with concepts related to how much force to apply when striking the cue ball, whether or how to apply spin to the cue ball, and what angle to aim the cue ball at an object ball or other target. The rules of competitive play of these cue sports often limit the tools available to players to devices that do not come into contact with the cue ball or play balls, such as mechanical bridges and cue stick extensions, which limits the ability of new players to grasp the more difficult concepts in those cue sports.

SUMMARY

This summary is provided to introduce a selection of concepts in a simplified format that are further described below in the Detailed Description section. This summary is not intended to identify all key or essential features of the claimed subject matter, nor is it intended as an aid in determining the scope of the claimed subject matter.

As competitive play for cue sports does not typically allow for electronic devices, such as aiming lasers, range finders, or the like, the present disclosure is related to optical aiming apparatuses and methods of use therefore that are non-electronic. The aiming apparatus of the present disclosure enables a player to locate and maintain a line of sight through the "ghost ball spot" on an object ball that the player desires to strike in a particular direction. The ghost ball spot identifies a fixed imaginary position on the cue sport table to which the player should aim the cue ball from its current position on the table to direct the object ball towards a target (another play ball, bumper, pocket, etc.). The aiming apparatus enables players to quickly, accurately, and optically determine the ghost ball spot for a selected play ball for a selected target without touching the cue ball or the play balls.

The aiming apparatus described herein works in conjunction with the body of a cue stick to direct the player's aim of the cue ball to the ghost ball spot on a selected play ball (i.e., an object ball) and a selected target. To use the aiming apparatus, the player positions the cue stick and aiming apparatus a set distance from the object ball and in line with the center of the object ball and the selected target—along a target line. Once the aiming apparatus and cue stick are positioned in line with the object ball and the selected target, the player rotates the cue stick and aiming apparatus about a pivot point of the aiming apparatus. The pivot point maintains an absolute position on the play surface so that as the apparatus and cue stick rotate, a fixed aiming position through the ghost ball spot is presented to the player. The player rotates the cue stick and aiming apparatus until the cue stick is oriented with the center of the cue ball—along an aim line. The cue stick thus presents a trajectory at which to aim the cue ball to strike the object ball at the ghost ball position without using electronics or touching any of the play balls or targets on the play surface.

At least one aiming apparatus may be integrated into a cue stick or provided as a selectively-attachable accessory; one that may be attached and removed at the player's discretion. The aiming apparatus may also be selectively-engagable, where it is rotated, slid, or swung into or out of an active aiming position at the player's discretion. Various configurations of the pivot point are provided to ensure that an absolute position is maintained on the play surface as the aiming apparatus and cue stick are rotated over the cue ball. Various indicators and features may also be provided to help ensure that proper contact is maintained with the play surface, that the aiming apparatus and cue stick are properly aligned, and that the aiming apparatus does not make contact with the balls in play.

The details of several examples are laid out in the accompanying drawings and the detailed description. One of ordinary skill in the art will appreciate several advantages and other features from a reading of the detailed description and reviewing the accompanying drawings. It is therefore understood that the detailed description and accompanying drawings are explanatory only, and do not restrict the claims.

BRIEF DESCRIPTION OF THE DRAWINGS

The below described drawings, which accompany and form a part of the present disclosure, illustrate various examples and aspects. The drawings are provided as non-limiting examples to illustrate various features and components of the present disclosure, and therefore may be shown in simplified formats with various elements shown out of scale to highlight aspects of the inventive concept described herein in greater detail. In the drawings.

DETAILED DESCRIPTION

Figure 1:
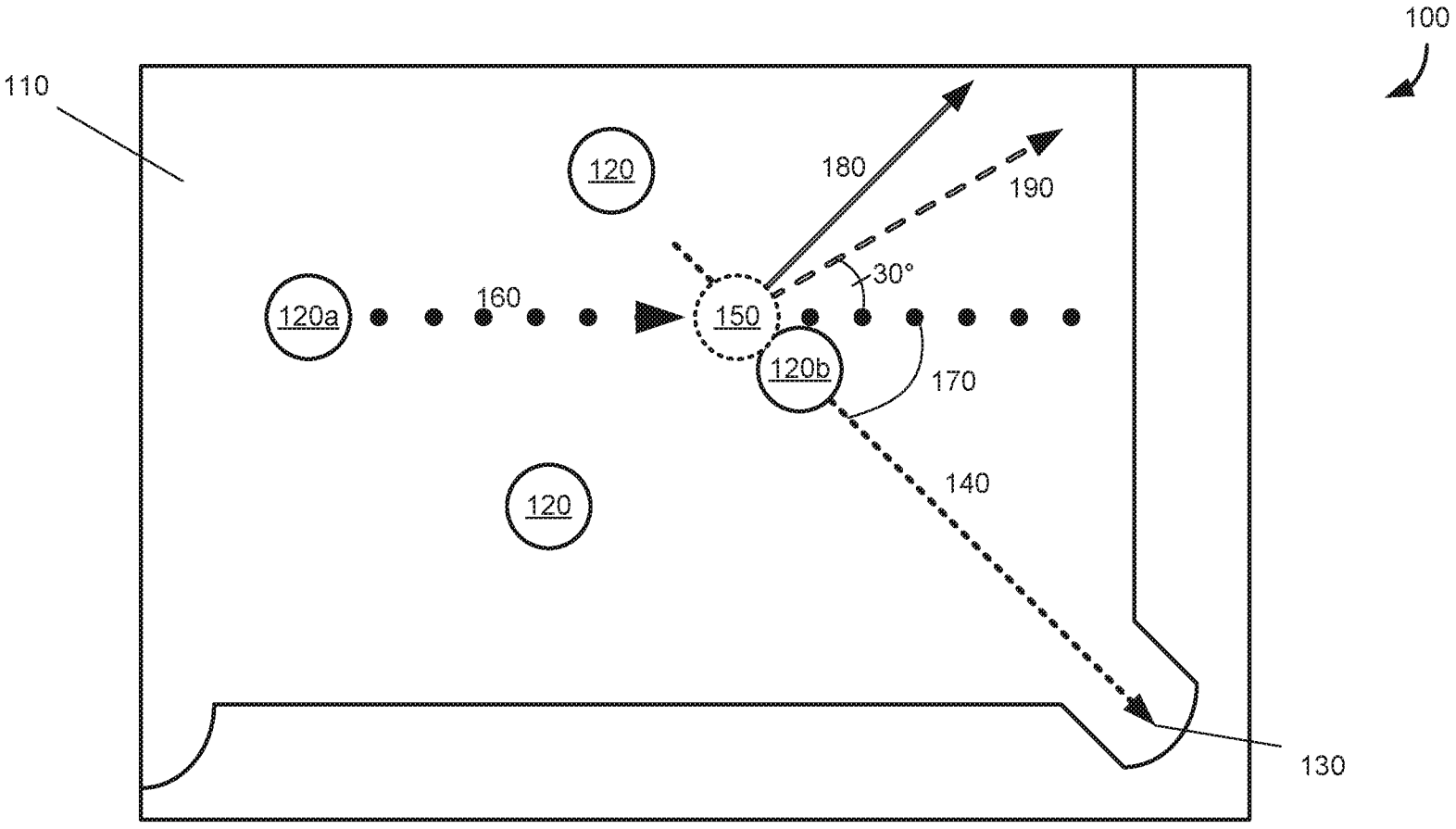
PRIOR ART Fig. 1
FIG. 1 illustrates an example layout of ghost-ball aiming.

In the following detailed description refers to the accompanying drawings are referred to and, wherever possible, the same reference numbers are used in the drawings and the following description to refer to the same or similar elements. While examples may be described, modifications, adaptations, and other implementations are possible. For example, substitutions, additions, or modifications may be made to the elements illustrated in the drawings, and the methods described herein may be modified by substituting, reordering, or adding stages to the disclosed methods. The following detailed description is, therefore, not to be taken in a limiting sense.

As competitive play for cue sports does not typically allow for electronic devices, such as aiming lasers, range finders, or the like, the present disclosure is related to optical aiming apparatuses and methods of use therefore that are non-electronic. The aiming apparatus of the present disclosure enables a player to locate and maintain a line of sight through a "ghost ball spot" on an object ball that the player desires to strike in a particular direction. The ghost ball spot identifies a fixed imaginary position on the cue sport table to which the player should aim the cue ball from its position on the table to direct the object ball towards a target (another play ball, bumper, pocket, etc.). The aiming apparatus enables players to quickly, accurately, and optically determine the ghost ball spot for a selected play ball for a selected target without touching the cue ball or the play balls.

As referred to herein, a play ball may refer to any ball on a playing surface that remains in play, including balls that, according to the rules of the game, the player is allowed to contact and those that the player is not allowed to contact; both directly and indirectly. A cue ball refers to a play ball that a player is allowed to strike with a cue stick. Different cue sports allow any play ball to be used as a cue ball, require one specific play ball to be used as the cue ball, or provide multiple specific cue balls (e.g., one for each player). An object ball refers to a play ball that has been selected by the player to initially hit via a struck cue ball. A target refers to a play ball selected to be subsequently struck by the object ball, a pocket to deposit one or more play balls, a bumper, a location on an edge of the play surface, or other location to which the object ball is directed.

As will be appreciated, a play ball that is a target may in turn be directed to another target; for example, when the cue ball hits a first ball (the object ball), which hits a second ball (a target ball), which in turn is directed to a pocket (a target for the combination shot). Similarly, an object ball may have multiple targets, such as when the initial target is a bumper which the target ball caroms off of to reach another play ball or a pocket (a final target). Although examples are primarily given herein in terms of a single target, one of ordinary skill in the art will understand that the teachings provided herein are applicable across multi-target shots.

FIG. 1 illustrates an example layout 100 of ghost-ball aiming. A top-down view of a portion of a billiards table is shown as a play surface 110 with several play balls 120 shown thereon. Of particular note among the play balls 120 are a cue ball 120*a* and an object ball 120*b*. As will be appreciated, play balls 120 may come in different sizes, colors, materials, and densities depending on the cue sport, the table in question, and the establishment that is making the cue sport available. For example, a coin operated billiards table may provide a cue ball 120*a* that is slightly smaller in diameter than the other play balls 120. Similarly, the composition of the play surface 110 may vary depending on the cue sport, the table in question, and the establishment that is making the cue sport available. For example, a first establishment may have a play surface coated with a felted fabric, such as worsted wool or a wool/nylon blend, while a second establishment may have a play surface coated with a synthetic fabric, such as a nylon derivative.

In FIG. 1, one of the pockets of the table has been selected as the target 130 for the object ball 120*b*. The dashed line between the object ball 120*b* and the target 130 illustrates the target line 140. The target line 140 is the most direct pathway that the object ball 120*b* can travel to reach the target 130. Also shown in FIG. 1, via a dashed circle, is a ghost ball spot 150. To propel the object ball 120*b* into the target 130 along the target line 140, a player must hit the cue ball 120*a* to the ghost ball spot 150 to strike the object ball 120*b*. The direct pathway that the cue ball 120*a* must travel is referred to as the aim line 160, and shown as a dotted line in FIG. 1 between the centers of the current position to the cue ball 120*a* and the ghost ball spot 150. The aim line 160 is illustrated as extending past the ghost ball spot 150 so that the cut angle 170 may be illustrated in FIG. 1. The cut angle 170 represents the angle between the target line 140 and the aim line 160. Also illustrated in FIG. 1 is a tangent line 180, shown as a double line, drawn extending from the center of the ghost ball point 150 at a ninety degree angle from the target line 140, which indicates a potential direction of travel of the cue ball 120*a* after impact with the object ball 120*b*. Another potential direction of travel of the cue ball 120*a* after impact with the object ball 120*b* is the roll line 190, which roughly is at thirty degree angle from the aim line 160, indicating a likely path of travel for the cue ball 120*a* if it is rolling when the object ball 120*b* is struck.

As will be understood, if the player selected a different target 130 (e.g., a carom point on the frame of the table, a target play ball 120, a different pocket), the relative locations and positions of the target line 140, ghost ball spot 150, aim line 160, and tangent line 180 will also be different to direct the object ball 120*b* to the different target 130. As will also be understood, the force applied to the cue ball 120*a*, as well as any spin, may result in different lengths or paths of travel for any struck play ball 120 than what is illustrated in FIG. 1.

Figure 2:
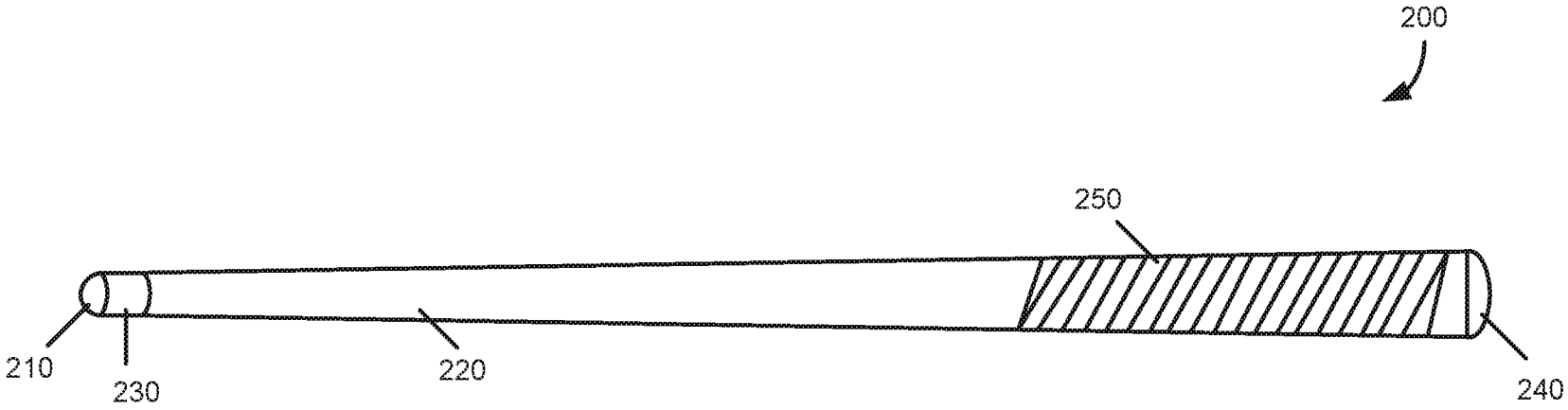
PRIOR ART Fig. 2
FIG. 2 illustrates example components for a cue stick.

FIG. 2 illustrates example components for a cue stick 200. As will be appreciated, a cue stick 200 is the stick used by a player in most cue sports to initially strike a cue ball 120*a*. A cue stick 200 may vary in length, thickness, material of composition, appearance, weight, weight distribution, etc., based on player preference and rules for a given game. The following example components are therefore given as non-limiting examples that are provided as reference for later discussion in the present disclosure.

As shown in FIG. 2, a cue stick 200 has two ends: a tip end that is designed to make contact with the cue ball 120*a* and a butt end that is opposite the tip end that is typically held by the player when striking the cue ball 120*a*. The tip end may include a tip 210 made of leather or similar material that is secured to the shaft 220 of the cue stick 200 by a ferrule 230 and/or by an adhesive. The butt end may include a bumper 240 to protect nearby walls when drawing back the cue stick 200 and/or a grip 250 to aid the player's control of the cue stick 200. Although some cue sticks 200 have shafts 220 made in one piece, other cue sticks 200 have shafts 220 that may be broken into multiple pieces and secured back together to allow for easier transportation or for the insertion of spacers/extensions to adjust the length of the cue stick 200. The shaft 220 of the cue stick 200 may vary in length and thickness, but the shaft 220 generally tapers from a first radius at the butt end to a second, smaller radius at the tip end. The degree of tapering may be consistent along the length of the shaft 220, or may vary across different portions of the shaft 220, although from the ferrule 230 through the tip 210, the cue stick 200 will often have a fixed radius.

Figure 3A:
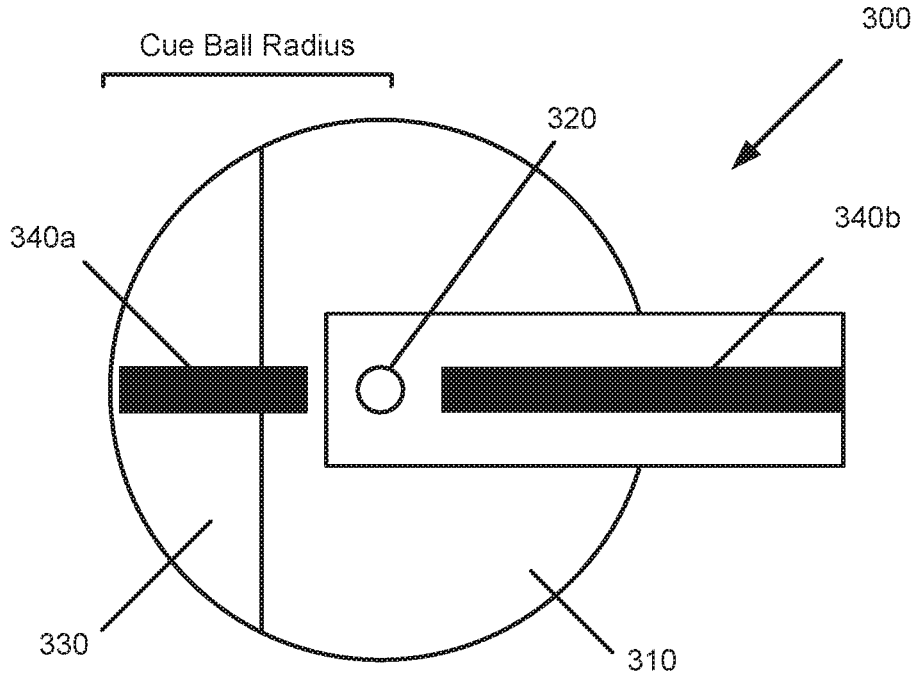
FIGS. 3A-B illustrate various examples and views of an aiming apparatus.
Figure 3B:
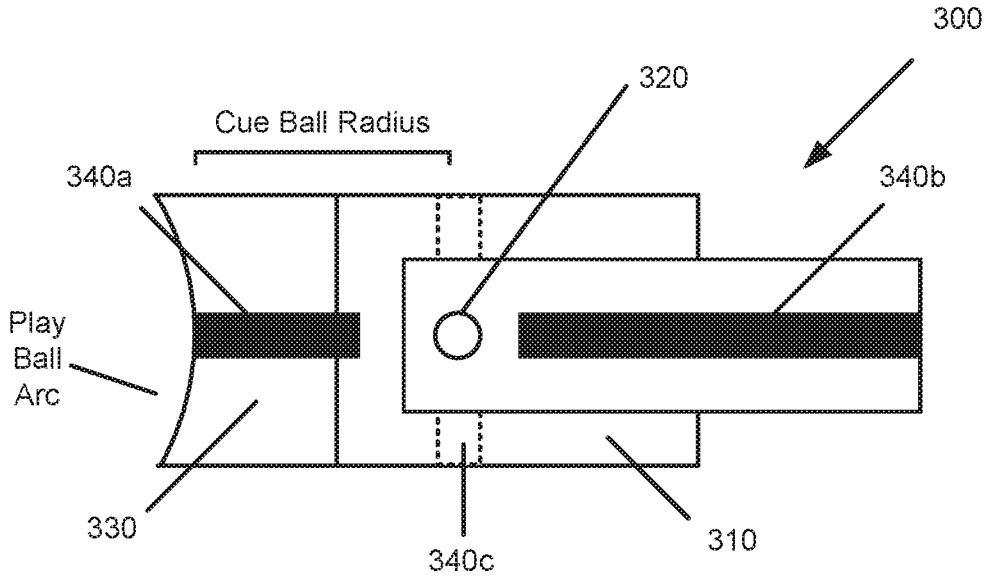

FIGS. 3A-B illustrate various examples and views of an aiming apparatus 300. These examples and views are provided as non-limiting examples to discuss the various features and elements of an aiming apparatus 300, but these features and elements may be added to, excluded, or rearranged in various aspects.

FIG. 3A illustrates a top-view of the aiming apparatus 300 that shows several components of the aiming apparatus 300, including an aiming platform 310 with a pivot 320 and a surface mirror 330, a first sight line 340*a*, and a second sight line 340*b* (collectively, sight lines 340). FIG. 3B illustrates a top-view of the aiming apparatus 300 that shows several components of the aiming apparatus 300 in different configurations than shown in FIG. 3A.

The aiming platform 310 extends from the aiming apparatus 300 to position the pivot 320 a predefined distance from the ballward edge of the aiming apparatus 300. When in use, the aiming apparatus 300 is aligned with the target line 140 and the aiming platform 310 is initially placed as close to the eventual contact point of the object ball 120*b* and the cue ball 120*a* without disturbing the object ball 120*b*. The pivot 320 is then placed into contact with the play surface 110, and the aiming apparatus 300 is rotated (about the pivot 320) to align the aiming apparatus 300 with the aim line 160.

As shown, the ballward edge of the aiming platform 310 in FIG. 3A is a convex curve and the ballward edge of the aiming platform 310 in FIG. 3B is a concave curve matched to the arc of a play ball 120. In other aspects, different shapes may be used for the ballward edge so long that when rotated, the lateral edges of the aiming platform 310 do not disturb the object ball 120*b*. Similarly, the outline of the aiming platform 310 may be different in different aspects, for example, rectangular (as in FIG. 3B), curved, cue ball-sized and shaped (as in FIG. 3A), etc. One of ordinary skill in the art will appreciate that various shapes may be employed for the aiming platform 310 for easier rotation (e.g., a smaller profile that is less likely to contact the object ball 120*b*), greater ability to stow away (e.g., formed to the profile of the cue stick 200), or greater visibility (e.g., shaped to the silhouette of an object ball 120*b* or sized and shaped like a cue ball 120*a*).

The aiming platform 310 provides a surface in which the pivot 320 is mounted. In various aspects, the pivot 320 is mounted in a fixed position that is one radius of a cue ball 120*a* from the ballward edge of the aiming platform 310. In other aspects, because play balls 120 may vary in diameter at different venues or when playing different cue sports, the pivot 320 is mounted at an adjustable position, that a player may adjust either ballward (closer to the ballward edge) or stickward (further from the ballward edge) to account for the different radii of the play balls 120, particularly the cue ball 120*a*. In further aspects, to account for trick shots, to compensate for player handicaps, to demonstrate poor form, etc., the pivot 320 is mounted in an adjustable position that a player may adjust laterally to the left or right from the centerline.

Some examples of the aiming platform 310 are made of a transparent or translucent material to enable a player to see the play surface 110 through the aiming platform 310. In other examples, a surface mirror 330 is incorporated into or onto at least a portion of the aiming platform 310 to reflect a mirror image of the aim line 160 (represented by the first sight line 340*a*) onto the image of the object ball 120*b* when positioning the aiming apparatus 300 underneath, and to help guide the player when positioning the aiming apparatus 300. In some examples, the surface mirror 330 is a flat mirror, but in other examples the surface mirror is a curved mirror (convex or concave) to provide different views from underneath the object ball 120*b* to the player.

Sight lines 340 are provided along the centerline of the aiming apparatus 300 as a visual means to align the cue stick 200 and the aiming apparatus 300 and indicate the final aim line 160 for a shot. In examples that use a selectively attachable accessory as the aiming apparatus 300, the second sight line 340*b* may be present on a portion of the accessory that attaches to the cue stick 200 or as a marking (e.g., a sticker, an ink/paint mark) on the cue stick 200. In examples that integrate the aiming apparatus 300 into the cue stick 200, the second sight line 340*b* may be present on the cue stick 200 while the first sight line 340*a* is present on the aiming platform 310. Although shown as solid lines of a given thickness, one of ordinary skill in the art will appreciate that other thicknesses, various colors, and aligned objects (e.g., gemstones, aiming beads) may also be used as sight lines 340.

In optional aspects, a third sight line 340*c* may be present that is at a 30° angle or is perpendicular to the first sight line 340*a* and the second sight line 340*b*. The first sight line 340*a* and the second sight line 340*b* allow the player to align the aiming apparatus 300 and cue stick 200 along the aim line 160. The optional third sight line 340*c* indicates to the player either the tangent line 180 (when at 90°) and/or the roll line 190 (when at 30°), to aid the player in striking a second play ball 120 with the cue ball 120*a*, to set up a subsequent shot, to avoid the cue ball 120*a* striking or entering forbidden targets (e.g., a pocket), etc. An optional third sight line 340*c* at 90° is shown in FIG. 3B as a dashed rectangle on the aiming platform 310, centered on the pivot 320 and perpendicular to the other sight lines 340, although additional or different third sight lines 340*c* may be provided for a 30° angle, or another angle to show potential paths of travel for the cue ball 120*a* after striking the object ball 120*b*.

FIGS. 4A-I illustrate various examples and views of a pivot 320. The pivot 320 is located a predetermined distance away from the leading edge of the aiming apparatus 300, typically substantially within the radius of a play ball 120, and may be provided in a variety of shapes and sizes. The pivot 320 is designed to maintain contact with the play surface 110 while the player rotates the aiming apparatus 300 and to not damage the play surface 110 when doing so. Although various example aiming apparatuses are shown with the various example pivots 320 in FIGS. 4A-I, one of ordinary skill in the art will be able to use any of the described pivots 320, and natural variations thereof, with multiple types of aiming apparatuses 300. Pivots 320 may be provided that are fixed-potion or moveable (rotating, extending, collapsing, storable, re-positionable, etc.) with various types of contact points for maintaining contact at an absolute point (e.g., the ghost ball spot 150) on a play surface 110.

Figure 4A:
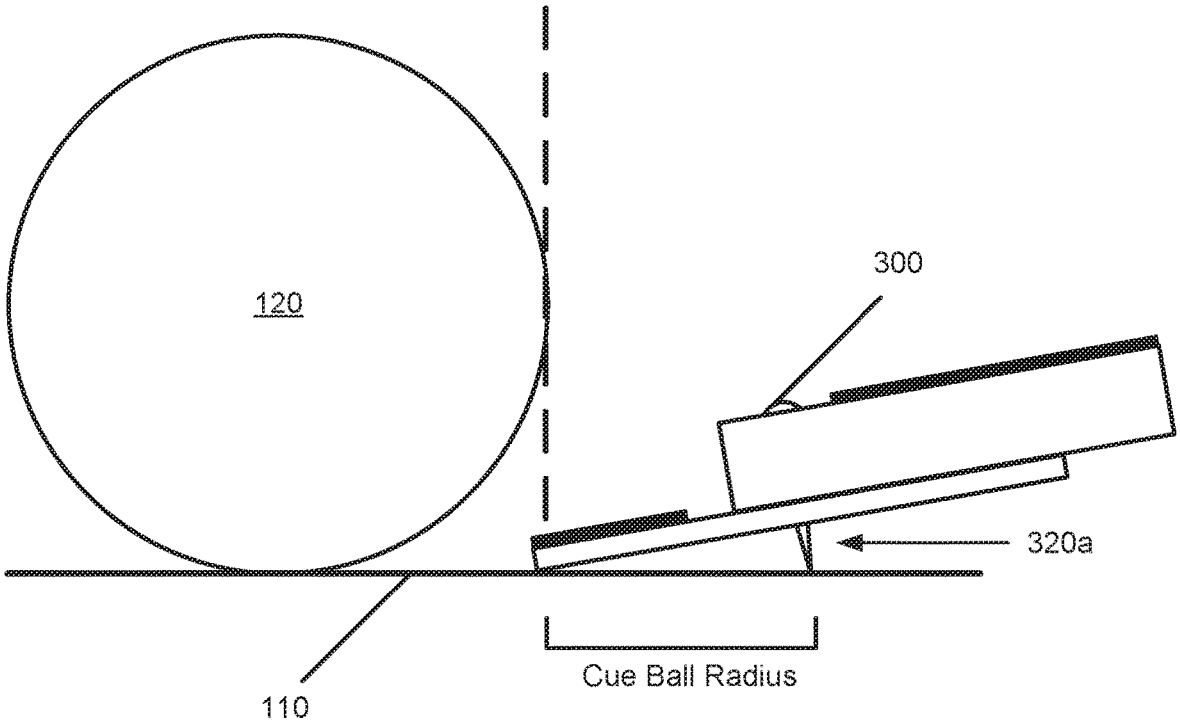
FIGS. 4A-I illustrate various examples and views of a pivot.

FIG. 4A illustrates a side-view of the aiming apparatus 300, highlighting a pin-type pivot 320*a*. The aiming apparatus 300 is shown positioned by an object ball 120*b* on the play surface 110 for reference. A pin-type pivot 320*a* provides a single point of contact on the play surface 110 about which the aiming apparatus 300 may rotate. A movable pin-type pivot 320*a* may be positioned or re-positioned in various through-holes defined through the aiming apparatus 300 that account for different play ball radii in different cue sports, such as 30.75 mm from a ballward edge for use in Carom billiards (using a 61.5 mm diameter cue ball 120*a*) and 25.25 mm from a ballward edge for use in Snooker (using a 52.5 mm diameter cue ball 120*a*). A fixed-position pin-type pivot 320*a* may extend through the aiming apparatus, as is illustrated in FIG. 4A, may extend partially through the aiming apparatus (e.g., be seated in a pocket), or may be mounted to or extend from a surface of the aiming apparatus 300.

The pin-type pivot 320*a* may be constructed from a variety of materials, such as plastics, metals, woods, ceramics, or stones/crystals. In some aspects, a precious or semi-precious stone is used, such as a diamond, sapphire, or emerald that is cut to provide a single point to make contact with the play surface 110. In other aspects, a coating is applied to the pin-type pivot 320*a* to help reduce wear and tear on the play surface 110 as the aiming apparatus 300 is rotated, such as, for example: a rubber, plastic, TEFLON®, or ceramic coating. In various aspects, the pin-type pivot 320*a* is pointed or is rounded at the point of contact.

Figure 4B:
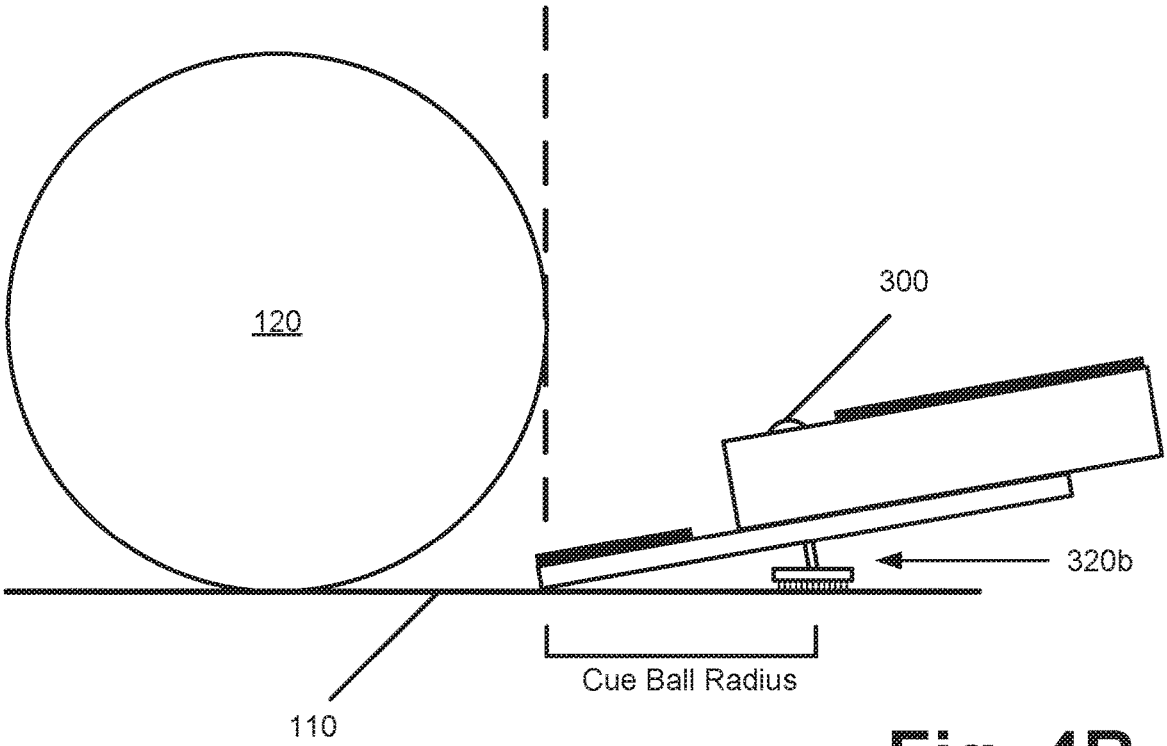

FIG. 4B illustrates a side-view of the aiming apparatus 300, highlighting a brush-type pivot 320*b*. A brush-type pivot 320*b* provides multiple potential points of contact on the play surface 110 about which the aiming apparatus 300 may rotate. A movable brush-type pivot 320*b* may be positioned or re-positioned in various through-holes defined through the aiming apparatus 300 that account for different play ball radii in different cue sports, such as 30.75 mm from a ballward edge for use in Carom billiards (using a 61.5 mm diameter cue ball 120*a*) and 25.25 mm from a ballward edge for use in Snooker (using a 52.5 mm diameter cue ball 120*a*). A fixed-position brush-type pivot 320*b* may extend through the aiming apparatus, as is illustrated in FIG. 4B, may extend partially through the aiming apparatus (e.g., be seated in a pocket), or may be mounted to or extend from a surface of the aiming apparatus 300.

The brush-type pivot 320*b* provides multiple contacts in a contact area that are designed to grip or partially penetrate the play surface 110. For example, a series of "hairs" of the contact area may penetrate into a textile coating of the play surface 110, while a roughly textured contact area (e.g., a "sandpaper" or a grated finish) may grip the play surface 110. In some aspects, the contacts are designed to make and break contact with the play surface 110 as the brush-type pivot 320*b* rotates with the aiming apparatus 300, while in other aspects, the brush-type pivot 320*b* (or its contact area) may remain in position while the aiming apparatus 300 rotates around it. For example, a shaft connecting the contact area to the aiming platform 310 may be connected to the aiming platform via a ball-and-socket joint or other joint that allows the shaft to rotate while the contact area remains in a fixed position on the play surface 110. Additionally, a hinge or a ball-and-socket joint allows for the contact area to remain in contact with the play surface 110 while the aiming apparatus pitches or rolls.

Figure 4C:
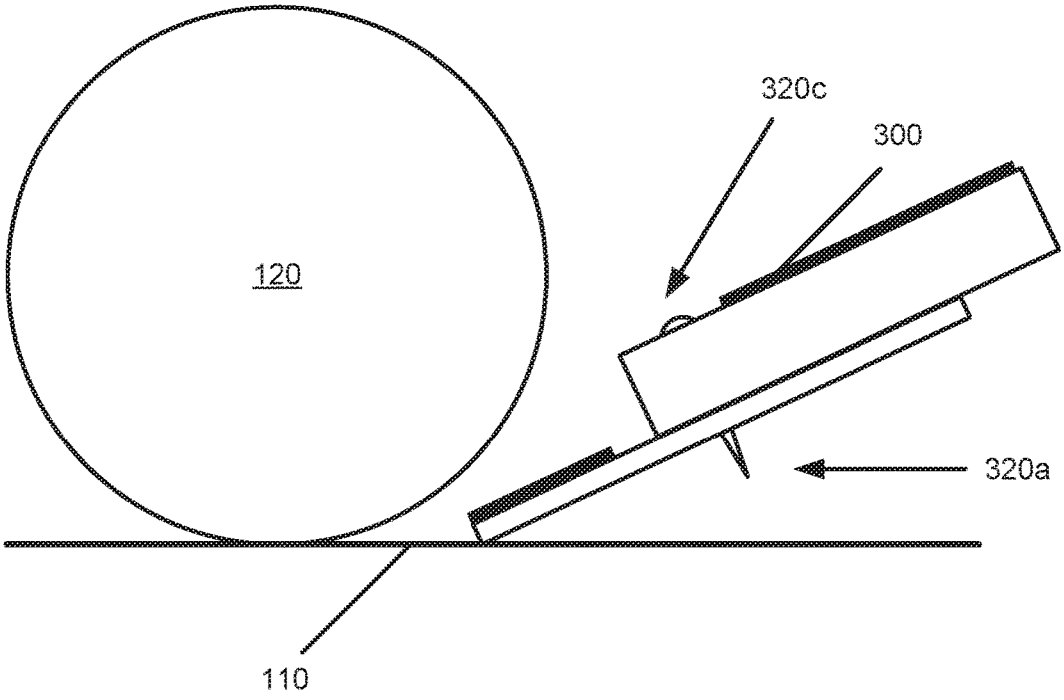
Figure 4D:
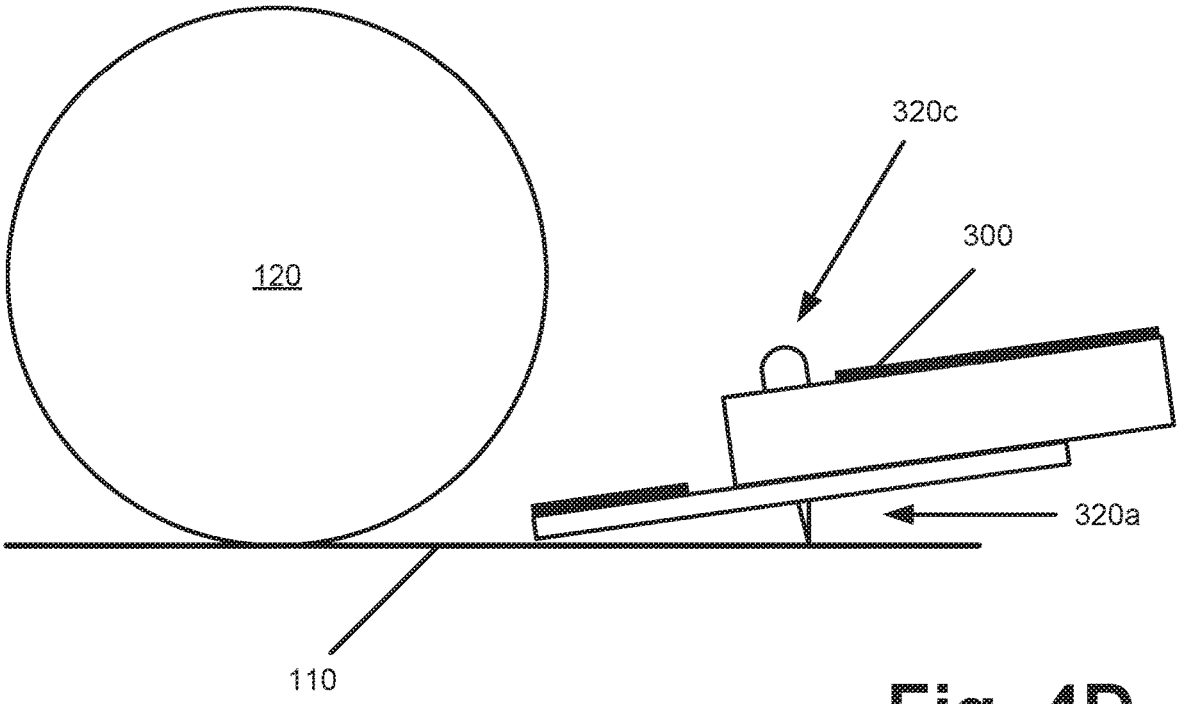

FIG. 4C illustrates a side-view of the aiming apparatus 300, highlighting a pop-up pivot 320*c* in a no-contact position, and FIG. 4D illustrates a side-view of the aiming apparatus 300, highlighting a pop-up pivot 320*c* in a contact position. A pop-up pivot 320*c* mechanically provides an indication to the player for when the pivot 320 makes contact with the play surface 110. As a player may make contact with the ballward edge of the aiming platform 310 and (inadvertently) not make contact with the pivot 320, a pop-up pivot 320*c* provides a check on the player's form when using the aiming apparatus 300. As will be appreciated, a pop-up pivot 320*c* may make use of a pin-type pivot 320*a* or a brush type pivot 320*b*.

In some aspects, such as is illustrated in FIGS. 4C and 4D, the pop-up pivot 320*c* moves up and down (relative to the play surface 110) semi-independently of the body of the aiming apparatus 300 to provide a visual indication that contact has been made with the play surface 110 by exposing a portion of the shaft of the pop-up pivot 320*c*. For example, the pop-up pivot 320*c* may "float" in a cavity defined in the aiming apparatus 300, such that a visual indicator portion of the pop-up pivot 320*c* will remain hidden unless an upward force (e.g., from the play surface 110) is exerted, thus exposing a portion of the pivot 320. In another example, a pop-up pivot 320*c* is held in place with a spring-loaded mechanism until a threshold pressure is exerted upward on the pop-up pivot 320*c* (e.g., weight is transferred through the pivot 320 to the play surface 110), thus allowing a portion of the pop-up pivot 320*c* to be exposed. In other aspects, in addition to or instead of a visual indication, an audible noise, such as a click or ratcheting sound is made when the pop-up pivot 320*c* makes contact with the play surface 110.

Figure 4E:
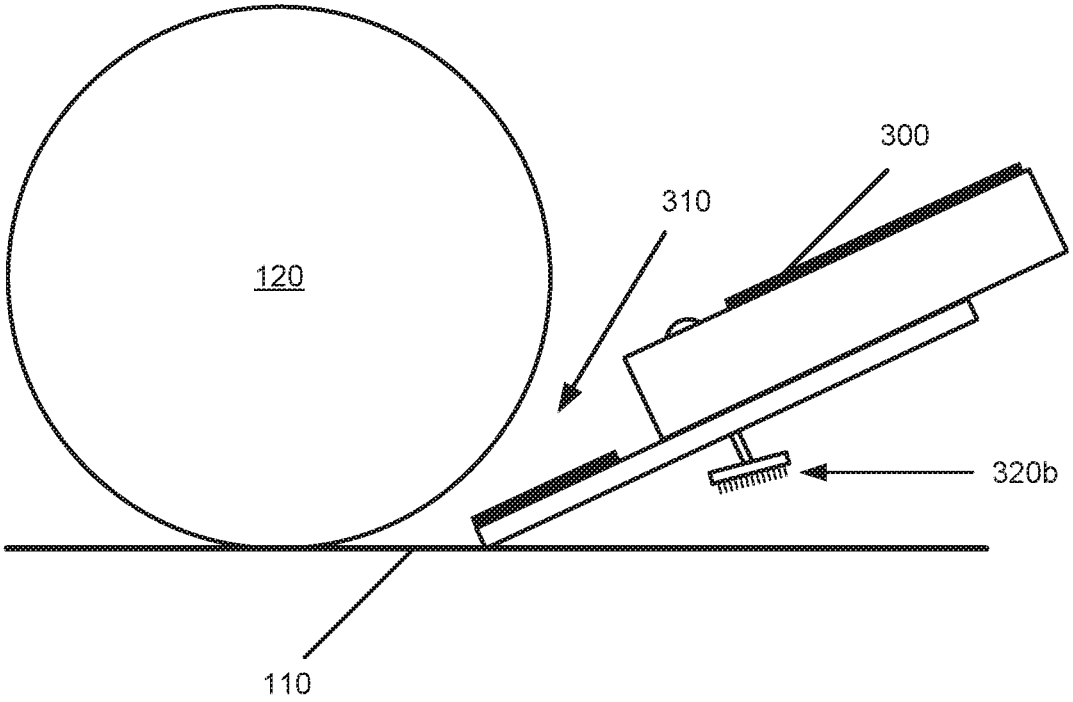
Figure 4F:
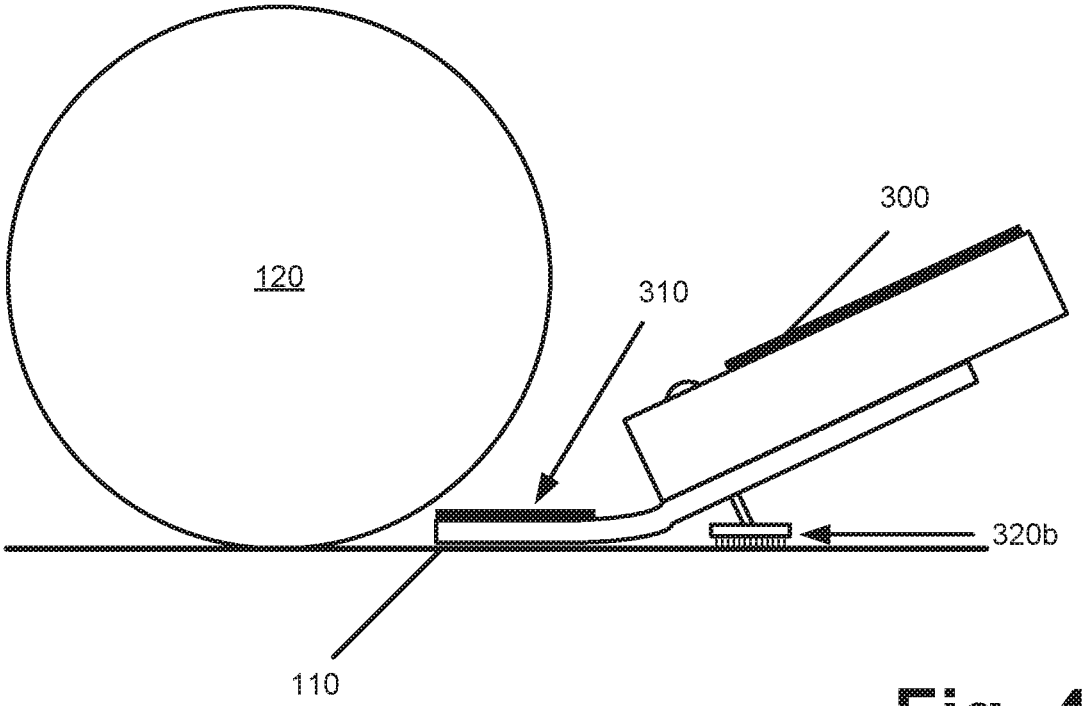

FIGS. 4E and 4F illustrate a side view of flexible aiming platform 310 used with a fixed-position pivot 320. As will be appreciated, the aiming platform 310 may be constructed out of a variety of materials, some of which are relatively inelastic (such as wood, paper, leather, glass, ceramics, crystal, and hard plastics, for example) and some of which are relatively elastic (such as latex, rubber, metals, and soft plastics, for example). When the aiming platform 310 is made of a material that can bend when the ballward end of the aiming platform 310 makes contact with the play surface 110 and the player continues to apply downward pressure to make contact with the pivot 320 to the play surface 110, and return (substantially) to its original shape when the player removes aiming apparatus 300 from the play surface 110, it is determined to have a flexible aiming platform 310. Additionally, an aiming platform 310 made of an inelastic material that incorporates a hinge or other joint to allow it to bend back and forth may also be classified as a flexible aiming platform 310.

FIGS. 4E and 4F illustrate a flexible aiming platform 310 in action, where the flexible aiming platform 310 makes contact with the play surface 110 in FIG. 4E, and bends to the position shown in FIG. 4F as the player continues to push downward. The bend introduced in the flexible aiming platform 310 allows the fixed-position pivot 320 to make contact with the play surface 110. If the player stops pushing downward, or pulls upward on the cue stick 200 relative to the play surface 110, the flexible aiming platform 310 will relax from the position shown in FIG. 4F to the position shown in FIG. 4E.

Figure 4G:
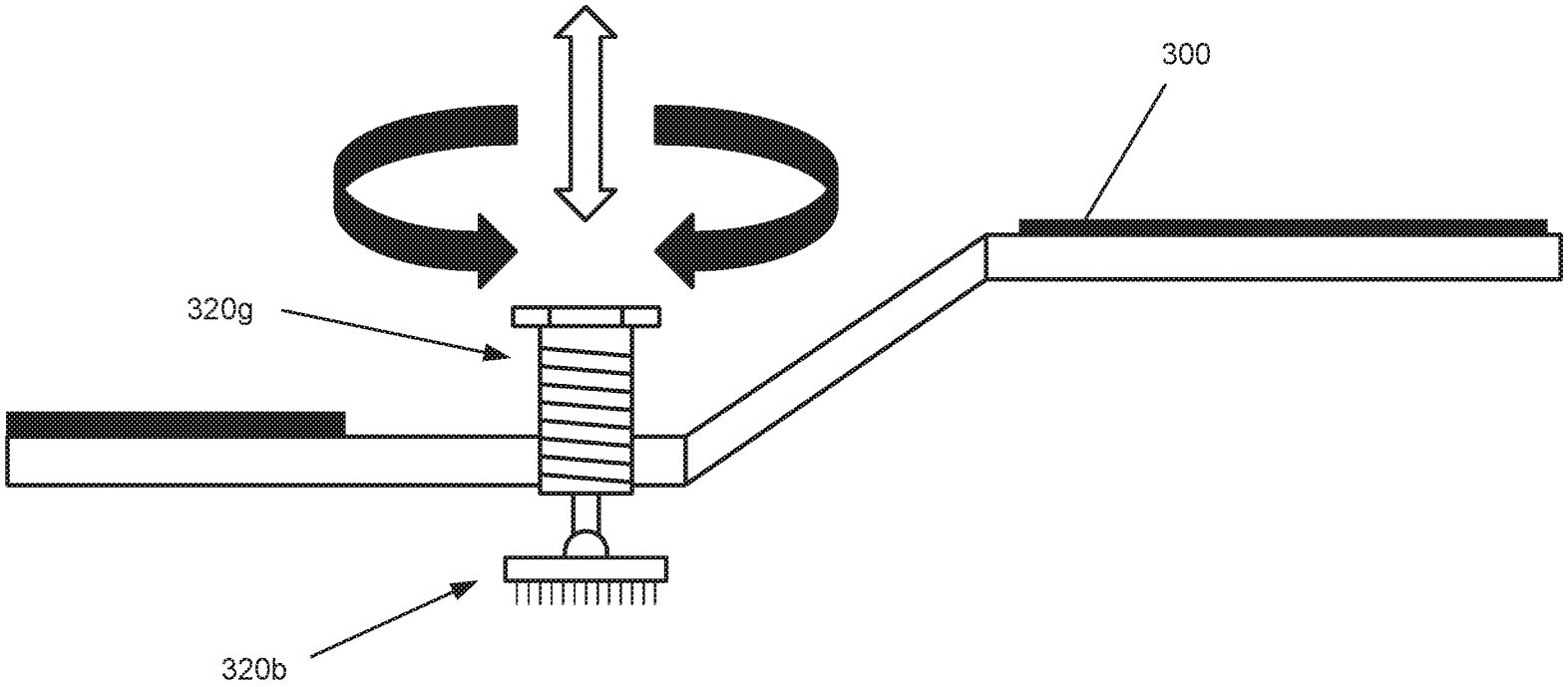

FIG. 4G illustrates a cutaway side-view of the aiming apparatus 300, highlighting a telescoping pivot 320*g* with a height adjustment screw. Because the angle at which the player holds the cue stick 200 (due to the proximity of an object ball 120*b* to a wall of the table, another play ball 120, player height, etc.) may affect whether the pivot 320 can contact the play surface 110 without an edge of the aiming apparatus 300 also (or instead) contacting the play surface 110, the player may find it desirable to adjust how far the pivot 320 protrudes downward from the aiming platform 310. In the example illustrated in FIG. 4G, the telescoping pivot 320*g* protrudes through a screw hole through the aiming platform 310, and the player may rotate the telescoping pivot 320*g* clockwise or counter clockwise to increase or decrease the portion of the shaft of the telescoping pivot 320*g* that is below the aiming platform 310 relative to the portion that is above the aiming platform 310. In other aspects, an extension may be added to or removed from the pivot 320 to adjust its height, or a pivot 320 of a first height may be replaced with a pivot 320 of a second height. In yet other aspects, a spring or a compressible material (e.g., sponge) is used to allow the height of the pivot 320 to be reduced by applying a compressive force on the pivot 320, allowing it to retract into a pocket.

Figure 4H:
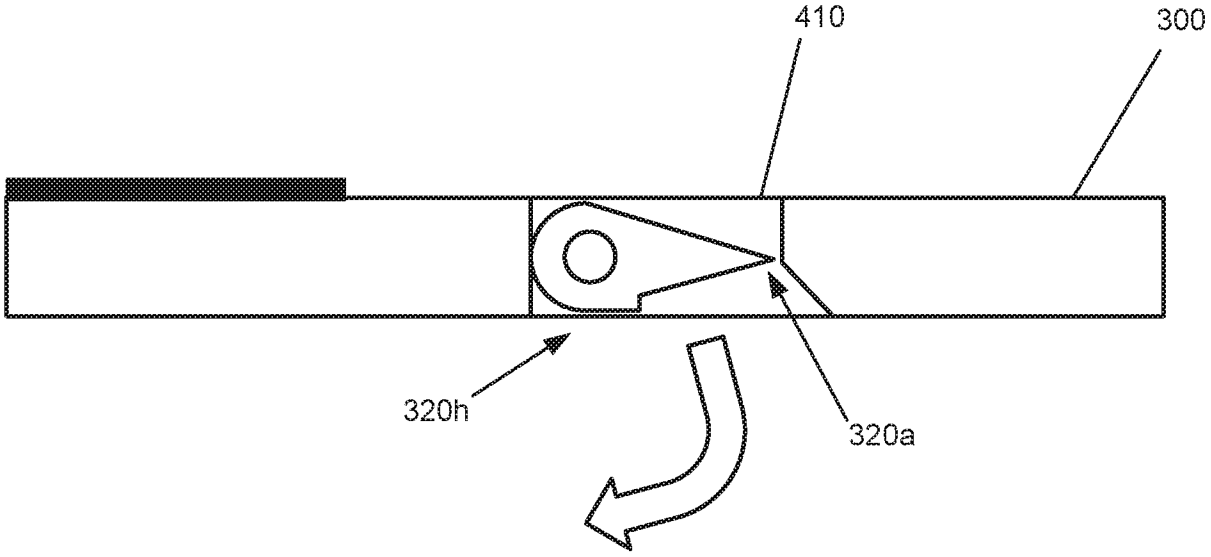

FIG. 4H illustrates a cutaway side-view of the aiming apparatus 300, highlighting a storable pivot 320*h*. In various aspects, pivot 320 may be stored within a cavity 410 defined in the cue stick 200 or the aiming apparatus 300 so that the contact point of the pivot 320 is hidden and the profile of the cue stick and/or aiming apparatus 300 is reduced (e.g., to protect the play surface 110 or the player's arm when making a shot, to aid in storage). In the illustrated example, the storable pivot 320*h* may be rotated into or out of the cavity 410 to engage or disengage the storable pivot 320*h*. In other aspects, the storable pivot 320*h* may be selectively removed from the aiming apparatus 300 for storage, transportation, or other use.

Figure 4I:
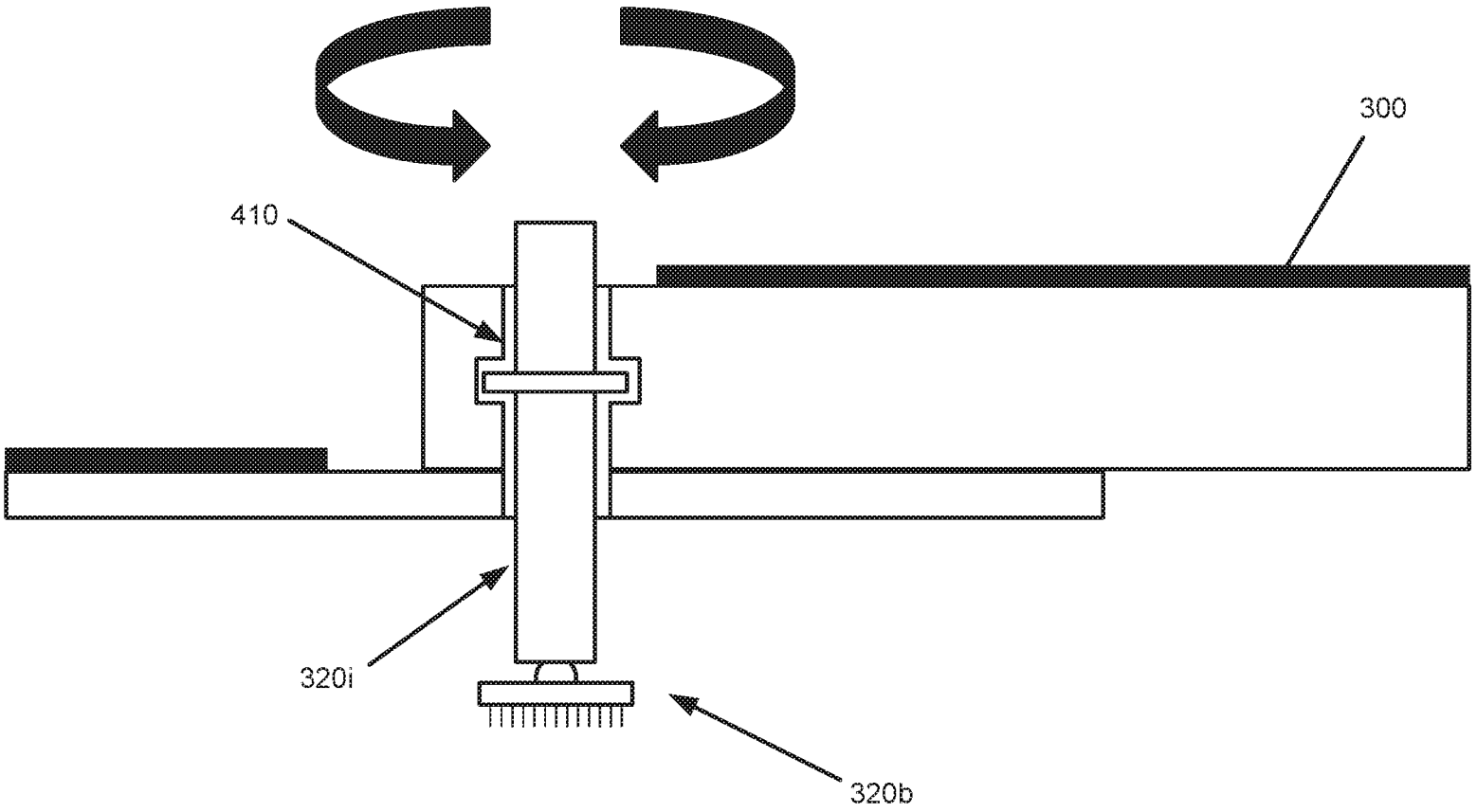

FIG. 4I illustrates a cutaway side-view of the aiming apparatus 300, highlighting a free-rotating pivot 320*i*. In the illustrated example, the free-rotating pivot 320*i* is captured in a cavity 410 defined in the aiming apparatus 300 that allows the free-rotating pivot 320*i* to spin independently of the rotation of the aiming apparatus 300. For example, once the pivot 320 grips play surface 110, the pivot 320 may remain fixed in place while the rest of aiming apparatus 300 is allowed to rotate around the pivot 320, thereby having potentially less impact on the finish of the play surface 110 that a fixed-position pivot 320 would have.

FIGS. 5A-D illustrate various examples and views of an accessory aiming apparatus 500. An accessory aiming apparatus 500 is a separate device that may be added to and removed from a cue stick 200 at the player's discretion, and allows for any cue stick 200 to be used in conjunction with the teachings of the present disclosure. As will be appreciated, an accessory aiming apparatus 500 may also be used without a cue stick 200, with a different cue stick 200 than the cue stick 200 used by the player to strike the cue ball 120*a*, or with a different stick or rod than a cue stick 200, such as the shaft of a mechanical bridge. The accessory aiming apparatus 500 includes any or all of the components of the aiming apparatus 300 discussed in FIGS. 3A-B and FIGS. 4A-I as well as an accessory connector 510 that is configured to selectively-attach the accessory aiming apparatus 500 to an attachment point on a cue stick 200. The attachment point may be on a tip end or a butt end of the cue stick 200, depending on player preference and the configurations of the accessory connector 510 and the cue stick 200.

Figure 5A:
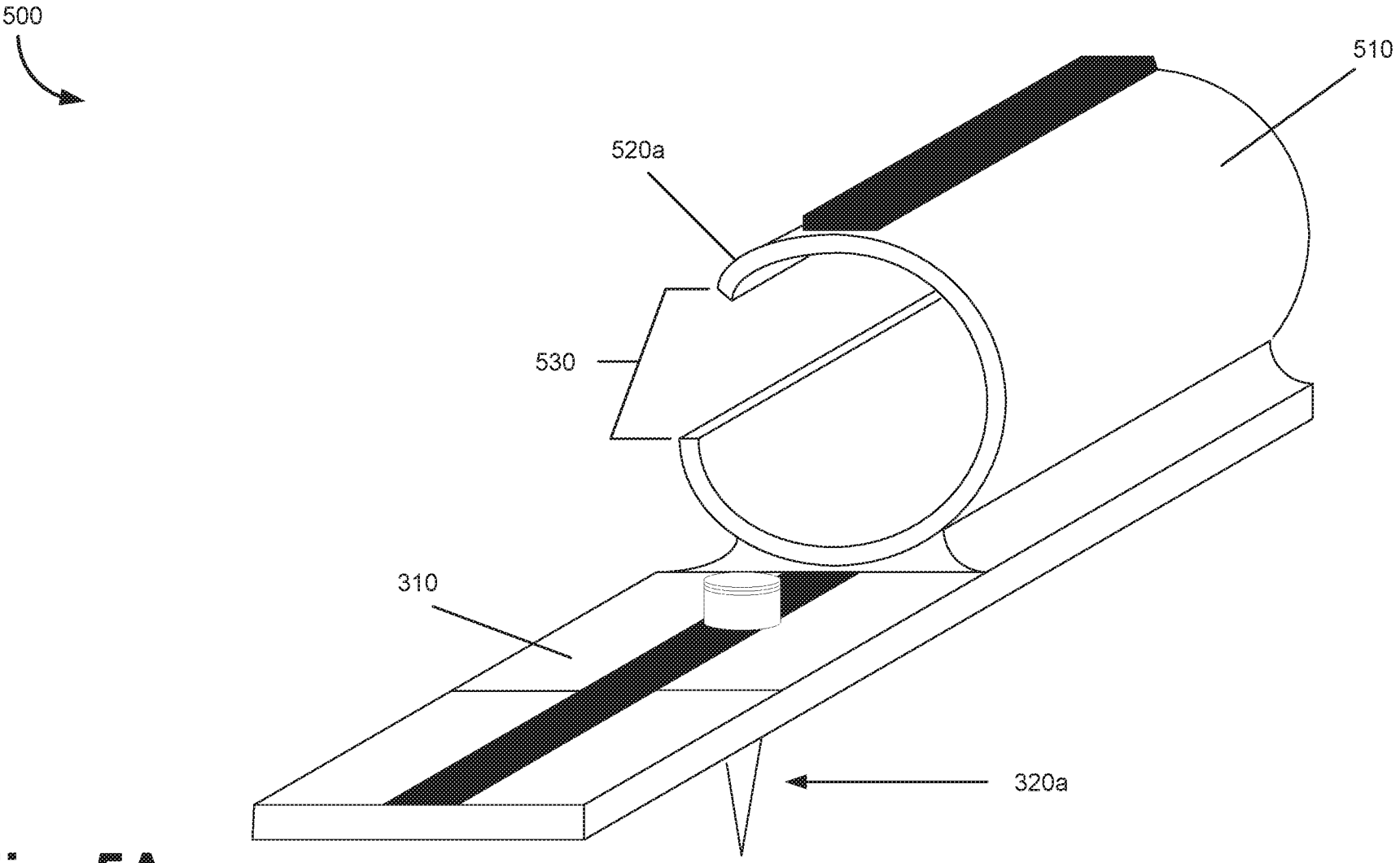
FIGS. 5A-D illustrate various examples and views of an accessory aiming apparatus.

FIG. 5A illustrates an accessory aiming apparatus 500 with an accessory connector 510 having a non-tapered body 520*a* that defines a ring with an opening 530 therein to accept an attachment point of the cue stick 200. The aiming platform 310 with an example pin-type pivot 320*a* extending outward from the accessory connector 510 is also illustrated. Although illustrated on one side, a non-tapered body 520*a* may place the opening 530 on the top or the bottom of the accessory connector 510, or omit the opening 530.

The opening 530 enables the player to position the accessory aiming apparatus 500 at various attachment points of the cue stick 200 without having to thread a tip or butt end through the length of the attachment point. Additionally, the opening 530 allows flexibility in the accessory connector 510, in that it may be secured to the cue stick 200 at portions thereof with greater diameter or tapering than the accessory connector 510 has in its resting state. In some aspects, the accessory connector 510 is made of a semi-rigid material that secures the accessory aiming apparatus 500 to the cue stick 200 via a clamping tension. In other aspects, the opening 530 may include a closure so that the accessory aiming apparatus 500 is secured to the cue stick 200 by reducing the aperture of the opening 530, thus providing clamping tension.

Figure 5B:
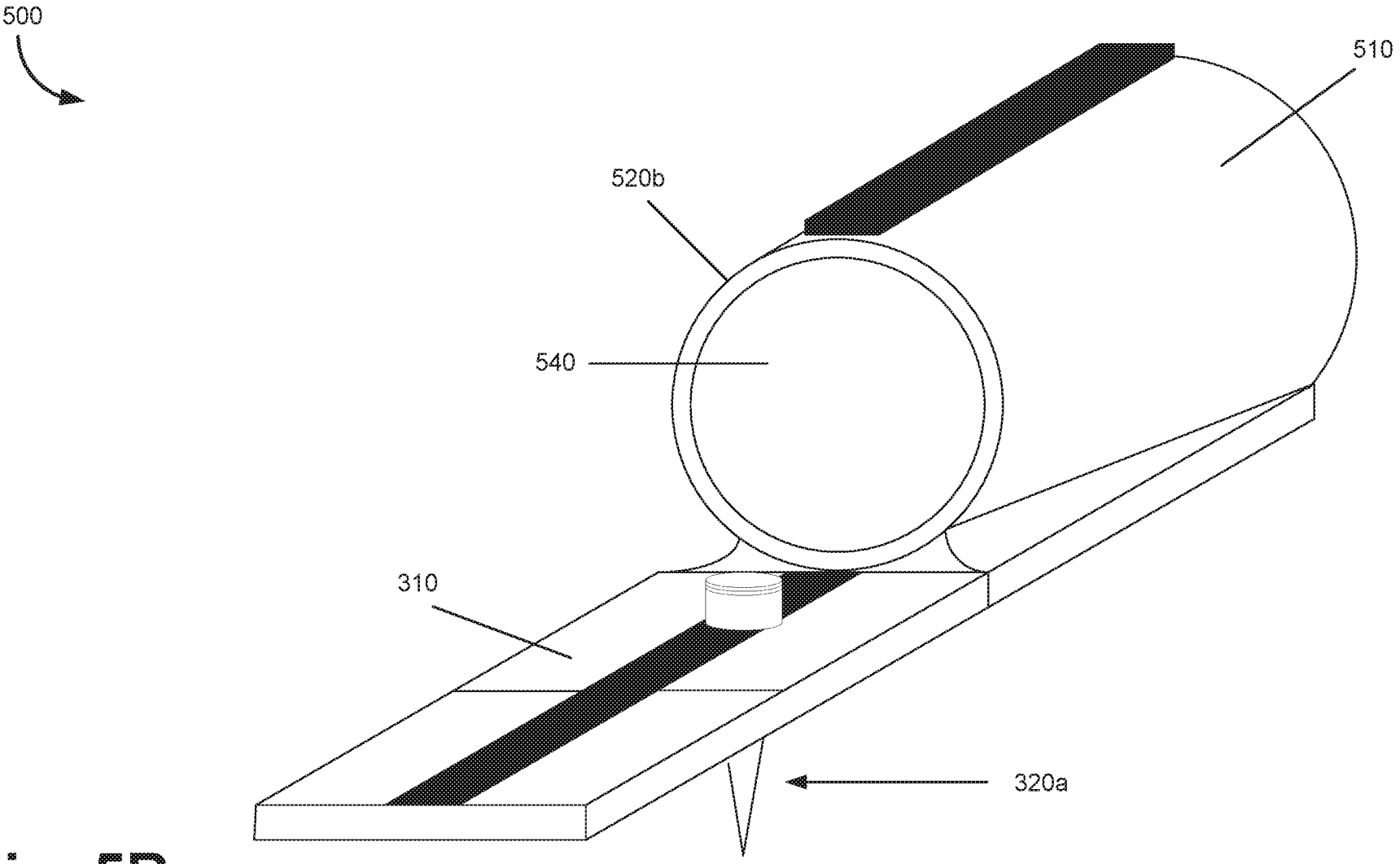

FIG. 5B illustrates an accessory aiming apparatus 500 with an accessory connector 510 having a tapered body 520*b* that defines ring with a through-hole 540 therein to accept an attachment point of the cue stick 200. The aiming platform 310 with an example pin-type pivot 320*a* extending outward from the accessory connector 510 is also illustrated. The tapered body 520*b* is configured to allow the cue stick 200 to slide into the accessory connector 510 up to, but not past, a predetermined length of the shaft 220 that has a corresponding diameter. For example, if a player inserts the tip end of the cue stick 200 into the through-hole 540, the increasing diameter of the shaft 220 of the cue stick 200 will engage with the walls defining the through-hole 540 to capture the cue stick 200 via friction and thereby secure the accessory aiming apparatus 500 to the cue stick 200.

Although illustrated with a narrowing taper (from the rear of the accessory aiming apparatus 500 to the ballward edge of the aiming platform 310), in other aspects a widening taper may be employed, such that the tip end of the cue stick 200 is inserted over the aiming platform 310 to thereby allow the free end of the aiming platform 310 to be provide at the butt end of the cue stick 200.

Figure 5C:
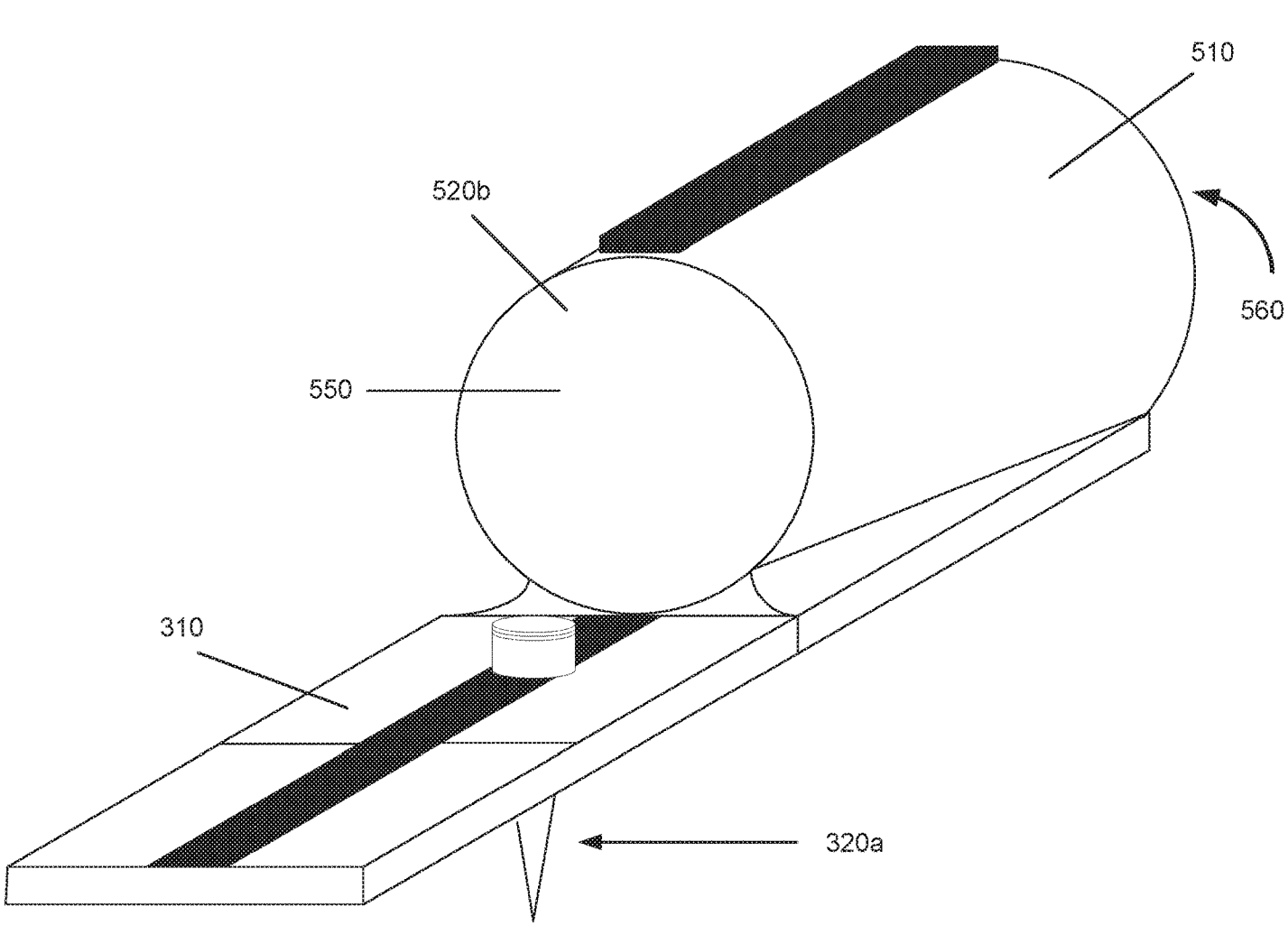

FIG. 5C illustrates an accessory aiming apparatus 500 with an accessory connector 510 having a tapered body 520*b* that defines ring with a capped hole 550 therein to accept an attachment point of the cue stick 200 but prevent the cue stick 200 from extending through the accessory connector 510. Although not shown in the illustrated angle in FIG. 5C, an access 560 to the capped hole 550 is included to accept a portion of the cue stick 200 into the capped hole 550. For example, if a player inserts the butt end of the cue stick 200 into the access 560, the first portion of the cue stick 200 will be of the greatest diameter and cannot be captured by the walls of the capped hole 550. The cap portion of the capped hole 550 therefore allows for the cue stick 200 to be inserted up to a predefined length that corresponds to the length of the capped hole 550.

Figure 5D:
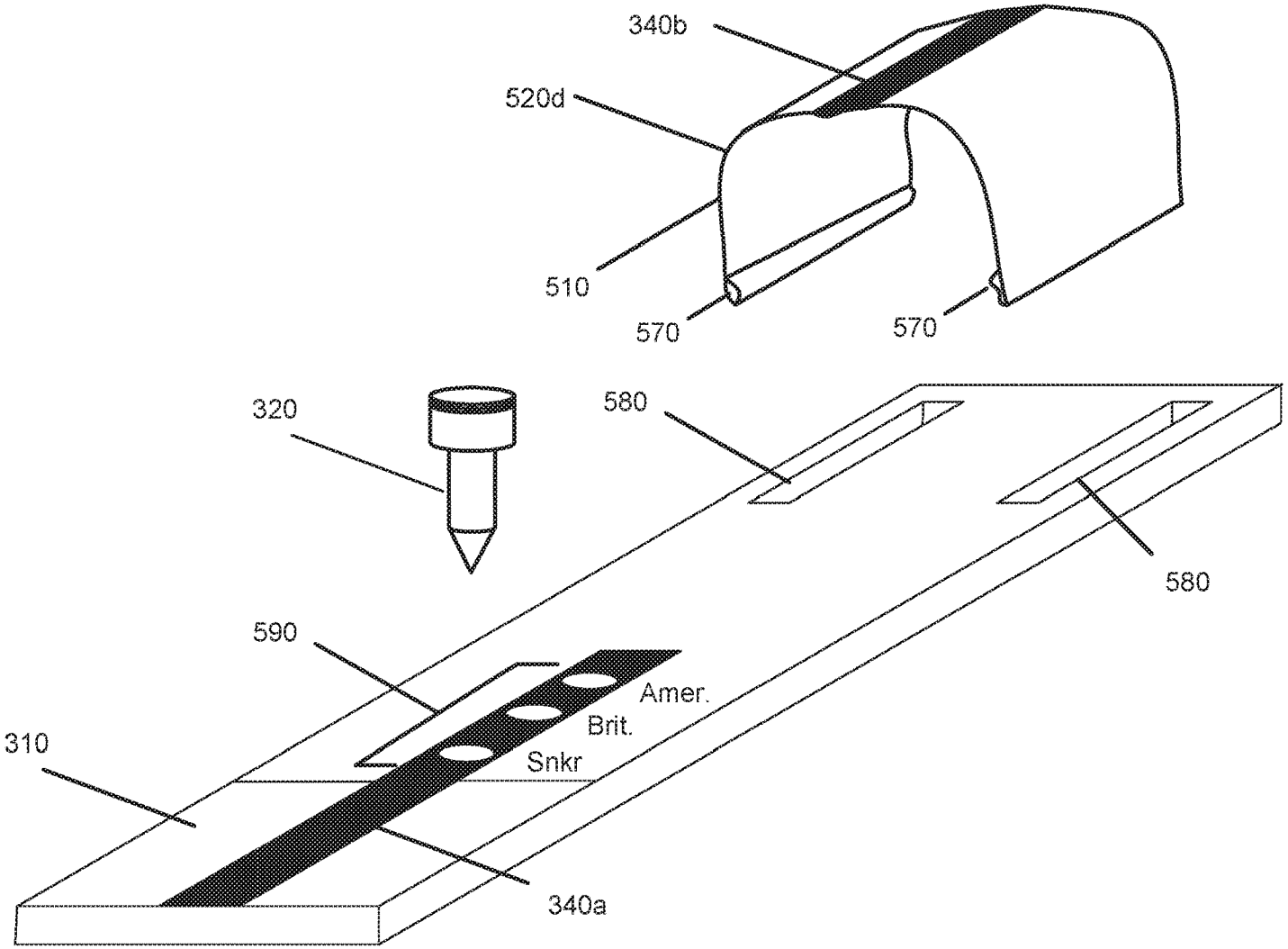

FIG. 5D illustrates an example exploded view of an accessory aiming apparatus 500 with an accessory connector 510 having a collapsible body 520*d*. The collapsible body 520*d* is made of a material that is able to loop over the shaft 220 of the cue stick 200 and thereby hold the shaft 220 to the accessory aiming apparatus 500 via constriction and/or friction, and that is not rigid, so that the cross-section of the accessory aiming apparatus 500 may be reduced by "collapsing" the accessory connector 510 (e.g., for storage). Materials for a collapsible body 520*d*, include, but are not limited to: a nylon elastic, a leather, a stretchable textile, a rubber, a latex, a polymer, etc.

As shown in FIG. 5D, the accessory connector 510 includes a second sight line 340*b* as well as two securing tabs 570. The securing tabs 570 are used to secure the accessory connector 510 to the aiming platform 310 through or in the illustrated connector holes 580, which are cavities or through-holes defined in the body of the aiming platform 310. In some aspects, the securing tabs 570 are portions of the collapsible body 520*d* that exceed a cross-sectional area of the connector holes 580, such as a gathered section of fabric sewn back onto the collapsible body 520*d* that are fed through the connector holes 580. In other aspects, the securing tabs 570 are portions of the collapsible body 520*d* that are coated with an adhesive to secure the collapsible body 520*d* to the aiming platform 310 in or through the connector holes 580. In further aspects, the securing tabs 570 are portions of the collapsible body 520*d* that are sewn, glued, or welded together after being fed through the connector holes 580 to form a loop. Other variations of securing tabs 570 and connector holes 580 are contemplated, and the above are given as non-limiting examples.

Additionally shown in FIG. 5D are pivot holes 590 that allow for a pivot 320 to be inserted into (and through) the aiming platform 310 and selectively removed, for example, to aid in storing the accessory aiming apparatus 500, to adjust a distance from the ballward edge of the aiming platform 310 for the pivot 320, or to substitute different pivots 320 (e.g., a taller pivot 320 or a pivot 320 with a different contact point). In some aspects, several pivot holes 590 are positioned at distances from the ballward edge of the aiming platform 310 that correspond to the radii for cue balls 120*a* used in different cue sports, allowing the accessory aiming apparatus 500 to be used across different cue sports.

Although the examples shown in FIGS. 5A-D are primarily illustrated with fixed-position aiming platforms 310, and using a pin-type pivot 320*a*, one of ordinary skill in the art will be able to configure an accessory aiming apparatus 500 to employ an accessory connector 510 and a non-fixed aiming platform 310 that may move into or out of a deployed position, using similar principles to those discussed in FIGS. 6A-F that are integrated into a cue stick 200 and with various types of pivots 320.

FIGS. 6A-F illustrate various examples and views of an integrated aiming apparatus 600. An integrated aiming apparatus 600 is a device that may be added to or built into a cue stick 200. The integrated aiming apparatus 600 includes any or all of the components of the aiming apparatus 300 discussed in FIGS. 3A-B and FIGS. 4A-I as well as an engagement feature that is configured to selectively engage and disengage the integrated aiming apparatus 600 to allow for ghost ball aiming, as described herein, and normal use of the cue stick 200. The engagement feature may be on a tip end or a butt end of the cue stick 200 or multiple engagement features (and integrated aiming apparatuses 600) may be incorporated into a single cue stick 200.

Figure 6A:
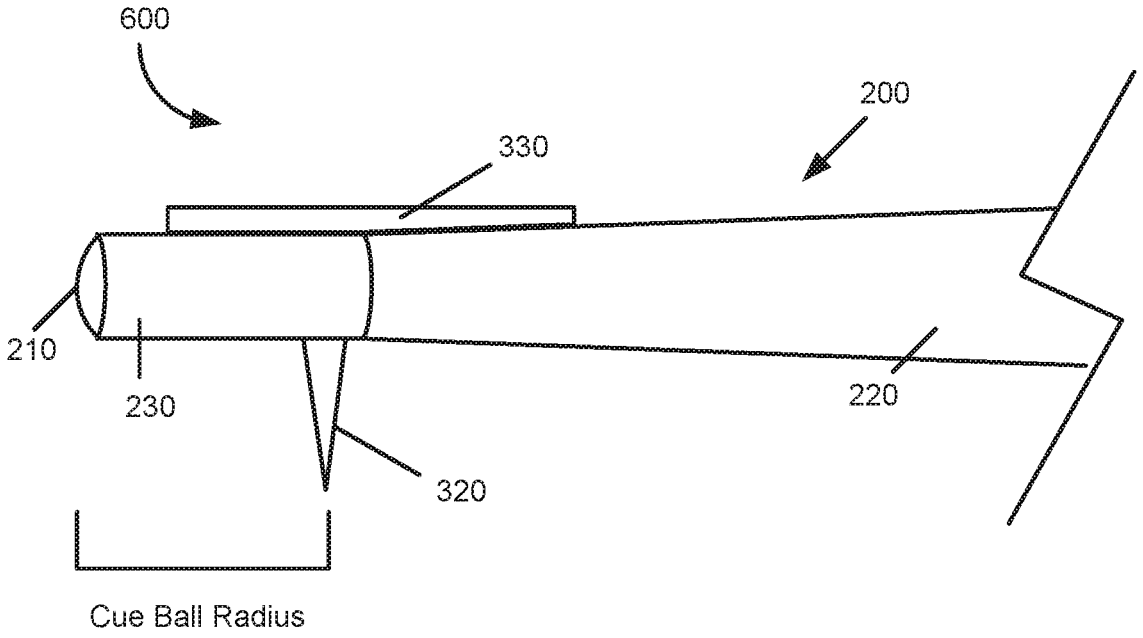
FIGS. 6A-F illustrate various examples and views of an integrated aiming apparatus.

FIG. 6A illustrates a side view of an integrated aiming apparatus 600 that has a pivot 320 built into the ferrule 230 of a cue stick 200. As shown, the contact point of the pivot 320 is one cue ball radius from the tip 210. Depending on the length of the ferrule 230 and the size of the cue ball 120*a* used in the particular cue sport, the pivot 320 of the integrated aiming apparatus 600 may be located in the shaft 220 of the cue stick 200 or a different position on the ferrule 230 than is illustrated. In various aspects, different types of pivots 320 may be integrated into the ferrule 230 (or shaft 220) including any of the pivots 320 discussed in FIGS. 4A-I and combinations thereof. Additionally, an integrated aiming apparatus 600 may optionally incorporate a surface mirror 330 (with or without sight lines 340) on the opposite side of the cue stick 200 from the contact point of the pivot 320, or a mirror finish may be applied to at least a portion of the ferrule 230 to act as a surface mirror 330.

Figure 6B:
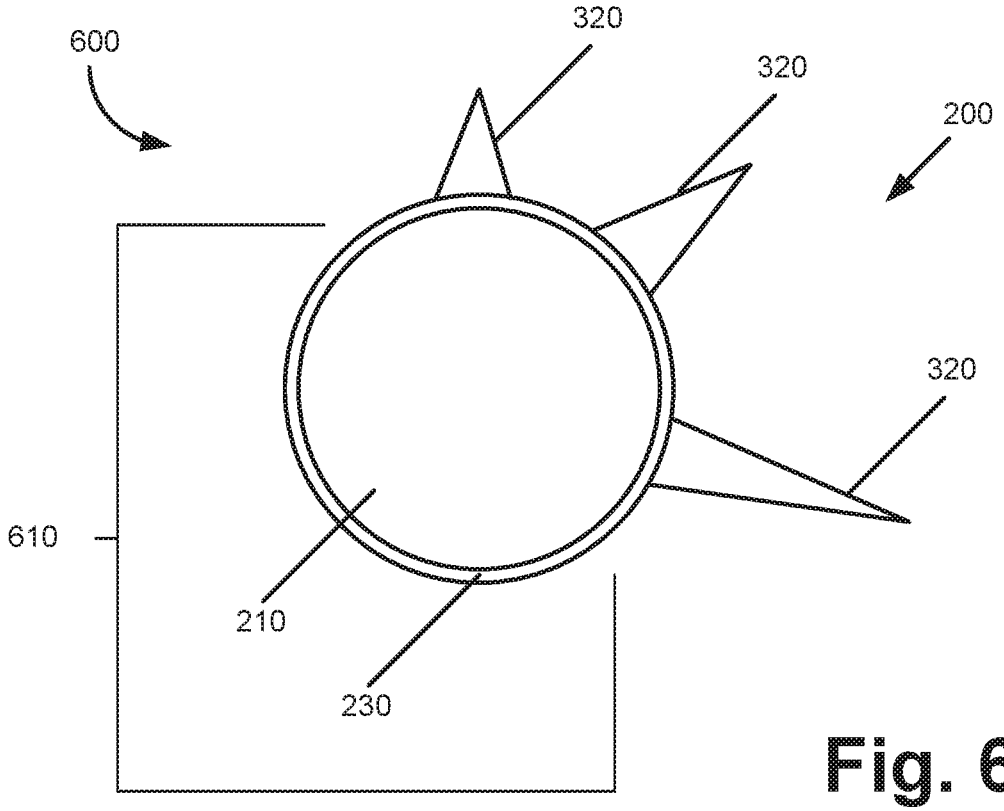

FIG. 6B illustrates a front view of an integrated aiming apparatus 600 that shows several pivots 320 built into the ferrule 230 or shaft of a cue stick 200. Each of the multiple pivots 320 illustrated in FIG. 6B are offset at different angles relative to one another on the cue stick 200 so that the player may select one of the pivots 320 to make contact with the play surface 110 without making contact with another pivot 320. Each of the illustrated pivots 320 is also shown as a different height, to allow the player to use different angles of approach when positioning the integrated aiming apparatus 600 so that the selected pivot 320 will make contact with the play surface 110 without the tip 210 or ferrule 230 making undesired contact with the play surface 110.

A portion of the circumference of the integrated aiming apparatus 600 is designated as a pivot-free arc 610 that is free from pivots 320 so that the player may rotate the pivots 320 away from the play surface 110 (rolling the cue stick 200 along its long axis) so as to not damage the play surface 110 when making a shot. Although three pivots 320 are illustrated, it will be understood that more or fewer pivots 320 may be used and that different types of pivots 320 may be integrated into the ferrule 230 (or shaft 220) including any of the pivots 320 discussed in FIGS. 4A-I and combinations thereof.

Figure 6C:
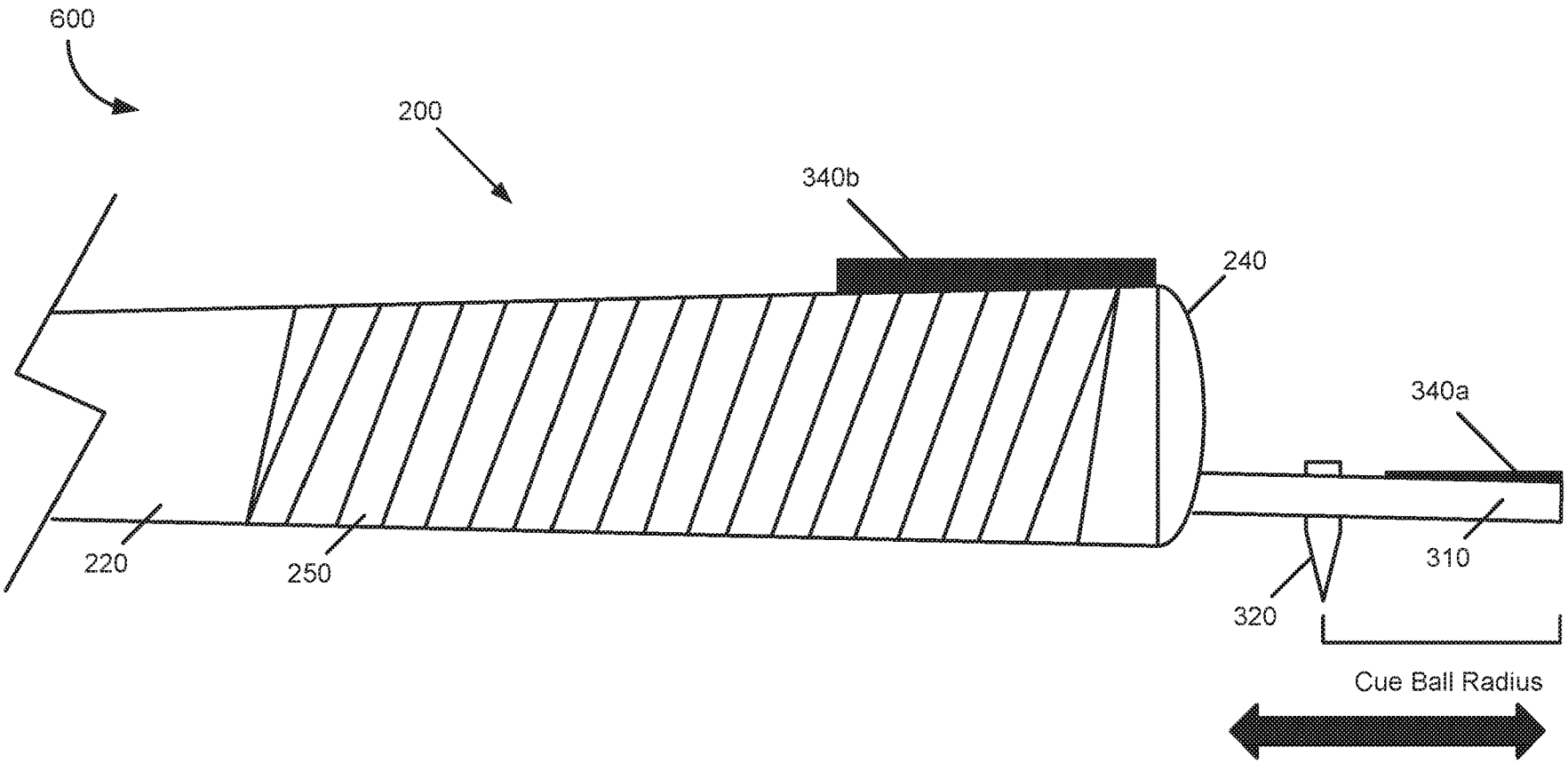

FIG. 6C illustrates a side view of an integrated aiming apparatus 600 that has a sliding aiming platform 310. As illustrated, the aiming platform 310 slides into or out of the butt end of the cue stick 200 into which it is integrated, but an aiming platform 310 may also slide into or out of the tip end of a cue stick 200 if so integrated. FIG. 6C shows the sliding aiming platform 310 in a deployed position, and when the aiming platform 310 is not deployed (i.e., is stored) the aiming platform 310 is fully or partially captured within the shaft 220 of the cue stick 200.

Although shown as extending through the bumper 240, a sliding aiming platform 310 may extend through the shaft 220 or grip 250 without extending through the bumper 240. Similarly, the integrated aiming platform 310 shown in FIG. 6C may be fixed in its position, such that the aiming platform 310 is connected to the cue stick 200 and does not slide into/out of a pocket, but remains with its free end extending from the cue stick 200.

In some aspects, the pivot 320 of a sliding aiming platform 310 may be a storable pivot 320*h*, that collapses into the sliding aiming platform 310 to reduce the cross section of the pocket or hole in the cue stick 200 slides into/out of. In other aspects, the pivot 320 is fixed in its position and acts as a catch that the player may use to pull the aiming platform 310 out of its pocket or push the aiming platform 310 back into its pocket.

Also shown in FIG. 6C are a first sight line 340*a*, on the aiming platform 310, and a second sight line 340*b*, on the grip 250. When integrated at the tip end of the cue stick 200, the second sight line 340*b* may be placed on the shaft 220 or the ferrule 230. Although illustrated as raised sight lines 340 extending from the cue stick 200 and aiming platform 310, in other aspects the sightlines may be indicated by paints, dyes, differently colored materials, etc. that do not raise the sight lines 340 from the portions of the integrated aiming apparatus 600 that they are positioned on.

Figure 6D:
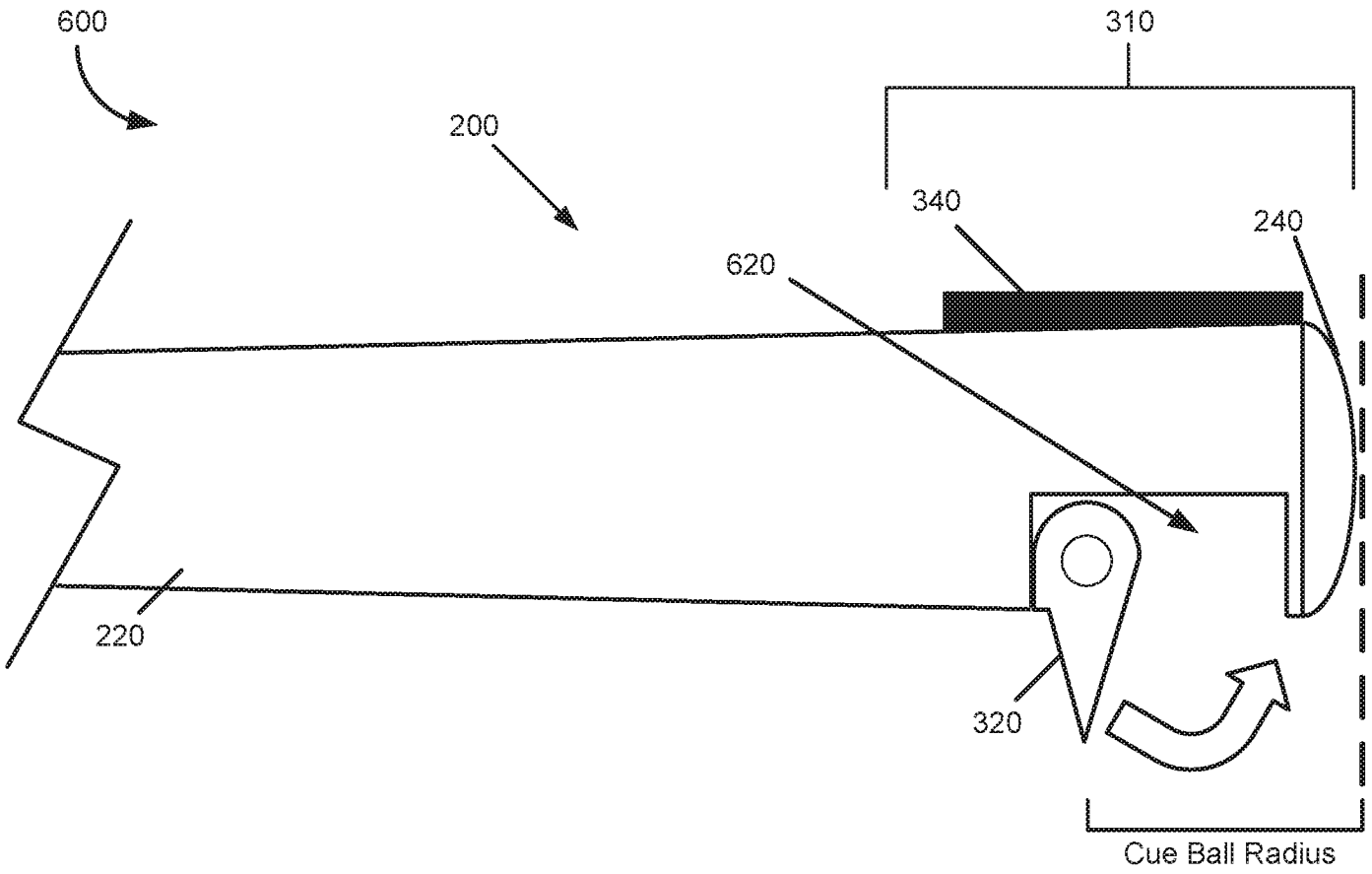

FIG. 6D illustrates a side view of an integrated aiming apparatus 600 that uses a portion of the butt end of the cue stick 200 as the aiming platform 310. As illustrated, the bumper 240 acts as the ballward end of the aiming platform, and a pocket 620 is defined within the cue stick 200 to hold a storable pivot 320, although fixed-position pivots 320 or other types of pivots, such as those described in FIGS. 4A-I, are also envisioned. When deployed, the contact point of the pivot 320 is located one cue ball radius from the edge of the bumper 240.

Figure 6E:
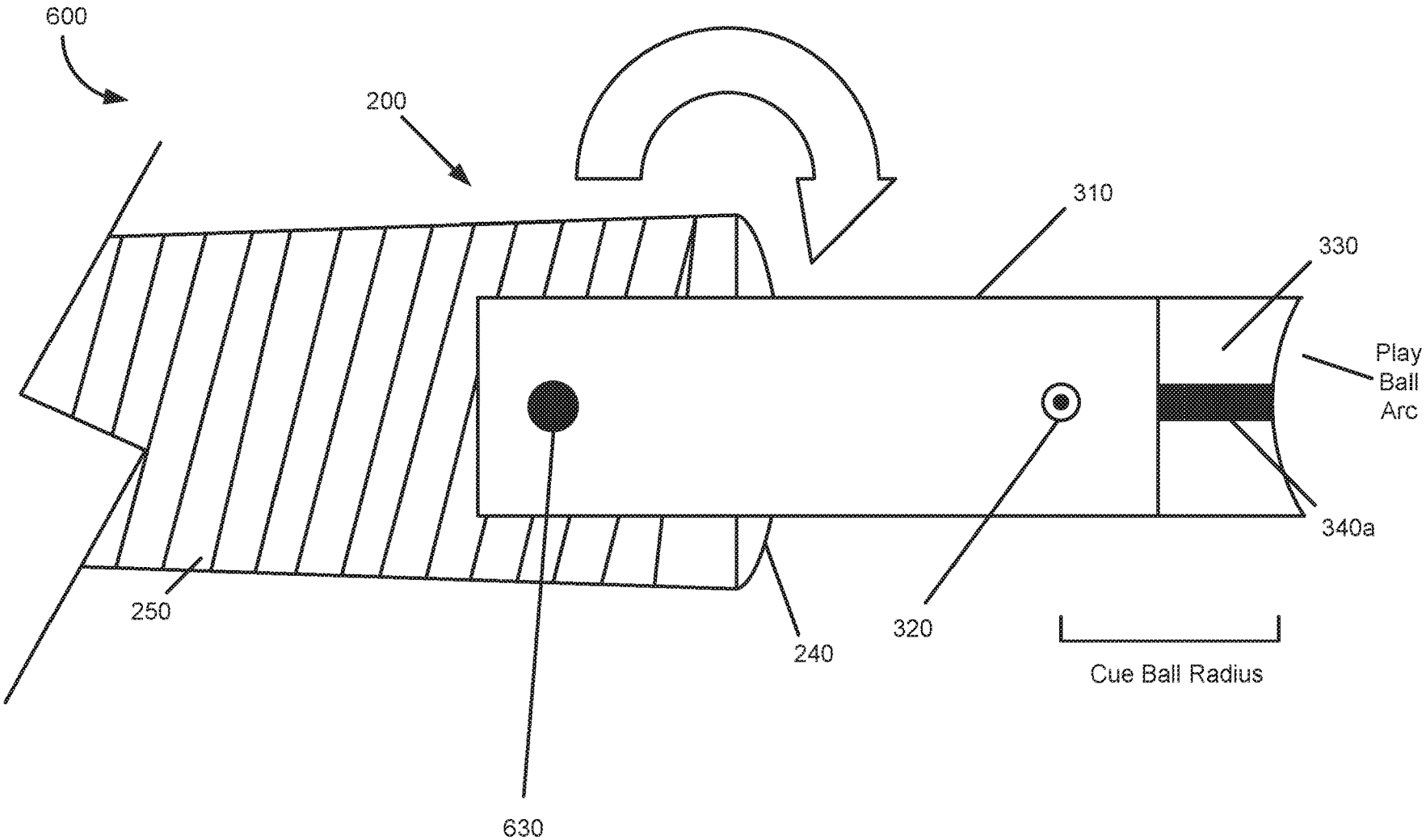

FIG. 6E illustrates a side view of an integrated aiming apparatus 600 that shows an aiming platform 310 that rotates (via yaw rotation relative to the axis of the cue stick 200) to swing out from the shaft 220 to an engaged position and swings back into the shaft 220 for a stored position. Although shown at the butt end of the cue stick 200, a yaw-rotating aiming platform 310 may also be integrated at the tip end of the cue stick 200. The swinging aiming platform 310 is connected to the shaft 220 via a rotation point 630, about which the aiming platform 310 rotates. In various aspects, the aiming platform 310 may rotate clockwise or counterclockwise about the rotation point 630, and the rotation point 630 may provide a ratchet or locking mechanism to secure the aiming platform 310 in a fully deployed or fully stored position when the long axis of the aiming platform 310 is aligned along the long axis of the cue stick 200. FIG. 6E shows the swinging aiming platform 310 in a fully deployed position, and when the aiming platform 310 is not deployed (i.e., is stored) the aiming platform 310 is positioned over the shaft 220 of the cue stick 200.

Figure 6F:
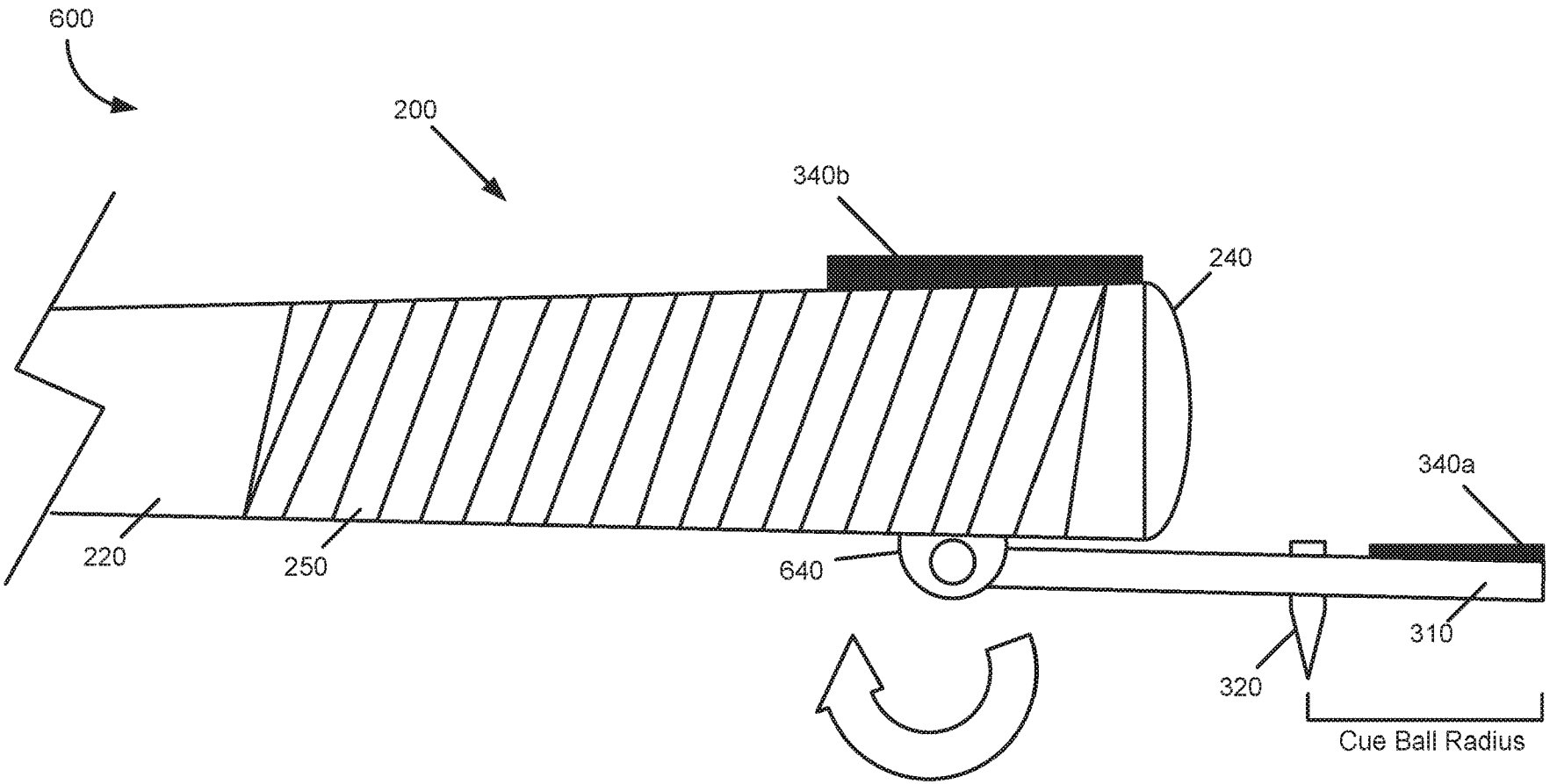

FIG. 6F illustrates a bottom view of an integrated aiming apparatus 600 that shows an aiming platform 310 that rotates (via pitch rotation relative to the axis of the cue stick 200) to swing out from the shaft 220 to an engaged position and swings back into the shaft 220 for a stored position. Although shown at the butt end of the cue stick 200, a pitch-rotating aiming platform 310 may also be integrated at the tip end of the cue stick 200. The swinging aiming platform 310 is connected to the shaft 220 via a hinge 640, about which the aiming platform 310 rotates. In some aspects, the hinge 640 may include a ratchet or locking mechanism to secure the aiming platform 310 in a fully deployed or fully stored position. FIG. 6F shows the swinging aiming platform 310 in a fully deployed position, and when the aiming platform 310 is not deployed (i.e., is stored) the aiming platform 310 is positioned over the shaft 220 of the cue stick 200.

In various aspects, the pivot 320 of a swinging aiming platform 310, such as shown in FIGS. 6E and 6F, is a storable pivot 320 that folds into the aiming platform 310 when the aiming platform 310 is stored. In other aspects, the shaft 220 includes a pocket into which a fixed-position pivot 320 is captured when the aiming platform 310 is swung into a stored position.

Figure 7:
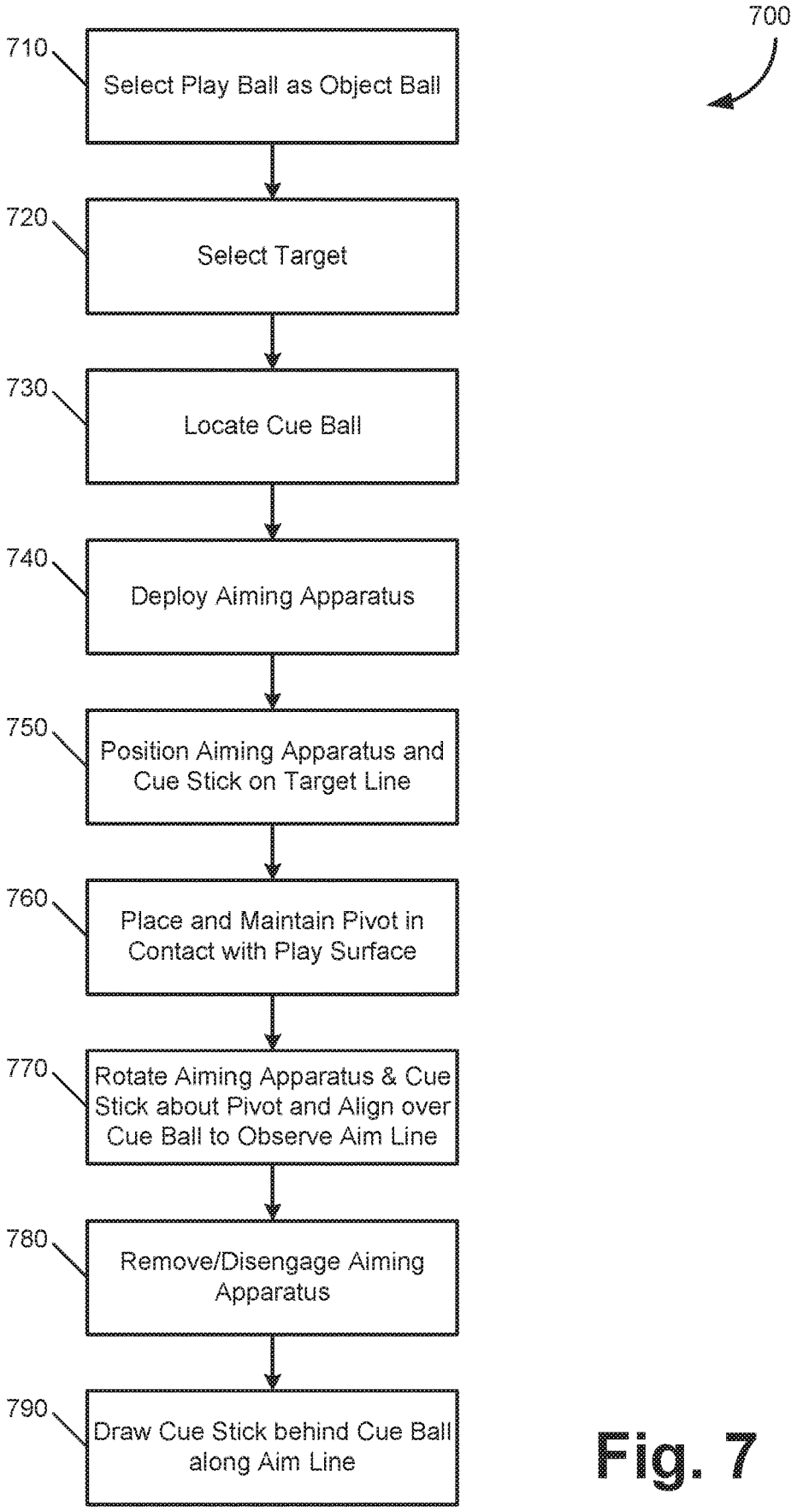
FIG. 7 illustrates a flowchart showing examples operations in a method for using an aiming apparatus as described herein.

FIG. 7 illustrates a flowchart showing examples operations in a method 700 for using an aiming apparatus 300 as described herein. Method 700 begins with OPERATION 710, OPERATION 720, OPERATION 730, and OPERATION 740, where the player selects a play ball 120 to be the object ball 120*b*, selects a target 130, and locates the cue ball 120*a*, and engages the aiming apparatus 300, respectively. In various aspects, the player engages the aiming apparatus 300 by attaching an accessory aiming apparatus 500 to a cue stick 200 or by deploying an integrated aiming apparatus 600. Although shown in an ordered list of operations, one of ordinary skill in the art will recognize that OPERATIONS 710, 720, 730, and 740 may be performed in any order or substantially simultaneously.

Method 700 proceeds to OPERATION 750 once the cue ball 120*a*, object ball 120*b*, and target 130 have been designated and the aiming apparatus 300 is deployed. At OPERATION 750, the aiming apparatus 300 and the cue stick 200 are aligned with the object ball 120*b* and the target 130 along the target line 140. In some aspects, when aligning along the target line 140, the tip 210 of the cue stick 200 (or an accessory tip 810; discussed in FIGS. 8A-H) is located at an edge of the object ball 120*b* at the height where the cue ball 120*a* and the object ball 120*b* will make contact. In aspects that use an aiming apparatus 300 with an aiming platform 310, the player positions the aiming platform 310 of the aiming apparatus 300 as close as possible to the object ball 120*b* without touching it (e.g., with the aiming platform at least partially under the edge of the object ball 120*b*) when aligning along the target line 140, so that the pivot 320 will be positioned one cue ball radius away from an edge of the cue ball 120*a*.

Proceeding to OPERATION 760, the player makes contact with the pivot 320 of the aiming apparatus 300 and the play surface 110. The player will lower the aiming apparatus 300 to the play surface 110 and make any adjustments to the height of the pivot 320 deemed necessary to make and maintain contact with the play surface 110. This contact is maintained throughout OPERATION 770, where the player rotates the aiming apparatus 300 and the cue stick 200 about the contact point to align the aiming apparatus 300 and the cue stick 200 with the cue ball 120*a* thus defining the aim line 160. The player may then break contact between the pivot 320 and the play surface 110, and (optionally) perform OPERATION 780 to remove or disengage the aiming apparatus 300.

At OPERATION 790, the player draws the cue stick 200 along the mentally noted aim line 160 to a position behind the cue ball 120*a* (relative to the object ball 120*b*). The player may then strike the cue ball 120*a* to make contact with the object ball 120*b* at the ghost ball spot 150 to thereby send the object ball 120*b* into the target 130, or repeat any portion of the above method 700.

FIGS. 8A-H illustrate various examples and views of tipped accessory aiming apparatuses 800*a-h* (collectively, tipped aiming apparatus 800). A tipped accessory aiming apparatus 800 is a separate device that may be added to and removed from a cue stick 200 at the player's discretion, and allows for any cue stick 200 to be used in conjunction with the teachings of the present disclosure, and for the player to aim and shoot a given shot without removing the tipped accessory aiming apparatus 800. As will be appreciated, a tipped accessory aiming apparatus 800 may also be used without a cue stick 200, with a different cue stick 200 than the cue stick 200 used by the player to strike the cue ball 120*a*, or with a different stick or rod than a cue stick 200, such as the shaft of a mechanical bridge. The tipped accessory aiming apparatus 800 includes any or all of the components of the aiming apparatus 300 discussed in FIGS. 3A-B and FIGS. 4A-I as well as an accessory tip 810 that is configured to make contact with the cue ball 120 instead of a tip 210 from a cue stick 200. The tipped accessory aiming apparatus 800 may be attached at a tip end or a butt end of the cue stick 200, depending on player preference and the configurations of the tipped accessory aiming apparatus 800 and the cue stick 200. When mounted to the cue stick 200, the accessory tip 810 is concentrically aligned with the body of the cue stick 200 so that a player is enabled to accurately strike the cue ball 120*a* via the accessory tip 810 of the mounted tipped accessory aiming apparatus 800.

Figure 8A:
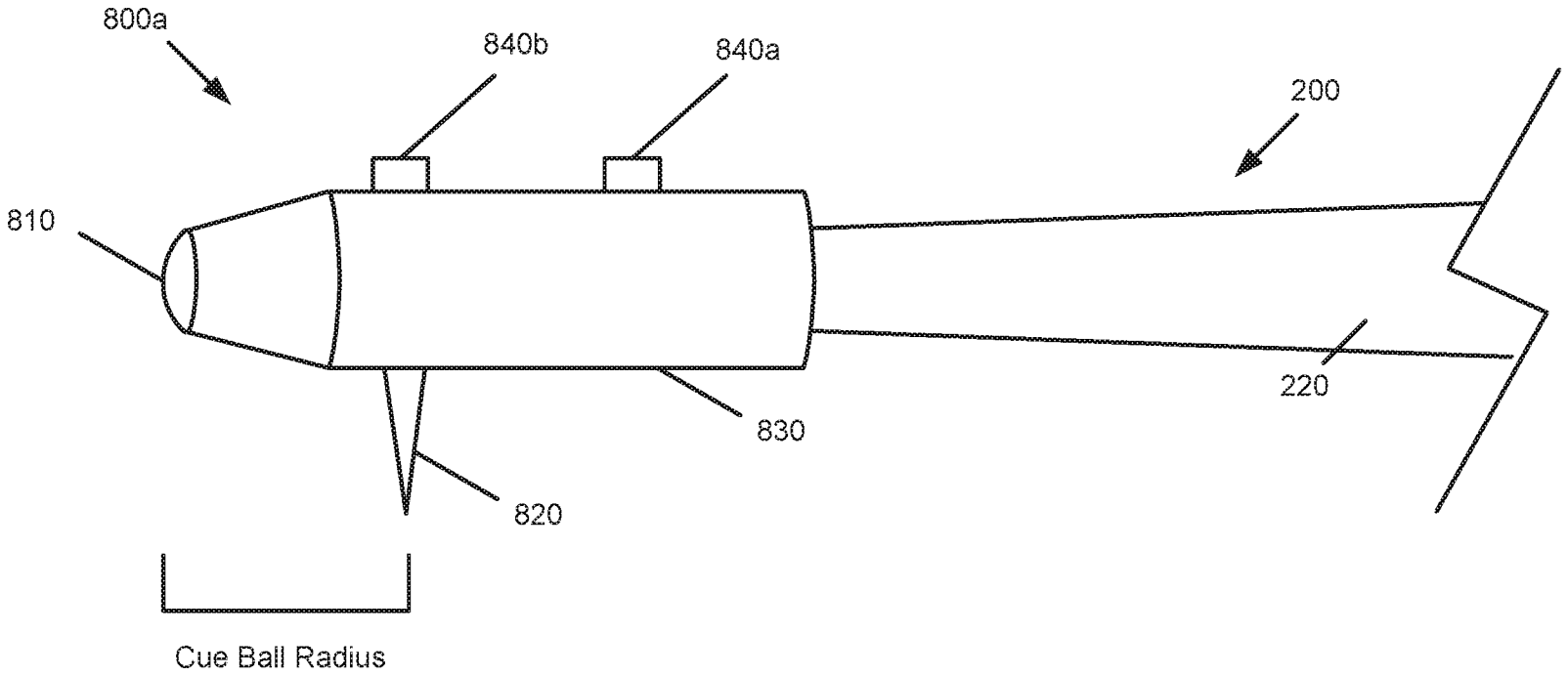
FIGS. 8A-H illustrate various examples and views of a tipped accessory aiming apparatus.

FIG. 8A illustrates a first example tipped accessory aiming apparatus 800*a* that is mounted at the tip end of a cue stick 200. As shown, the tipped accessory aiming apparatus 800 includes an accessory tip 810, and an accessory pivot 820 mounted one cue ball radius from the accessory tip 810 on the casing 830 of the tipped accessory aiming apparatus 800. Although illustrated in the current example as a pin-type pivot 320*a* that is fixed, one of ordinary skill in the art will appreciate that any of the pivots 320 (including fixed, removable, and storable varieties thereof) may be used with a tipped accessory aiming apparatus 800. Additionally shown attached to the casing are a first sight 840*a* and a second sight 840*b* (collectively, sights 840), that enable the player to align the tipped accessory aiming apparatus 800 and cue stick 200 to make a shot. One of ordinary skill in the art will recognize that more or fewer sights 840 may be used in other examples of a tipped accessory aiming apparatus 800.

Figure 8B:
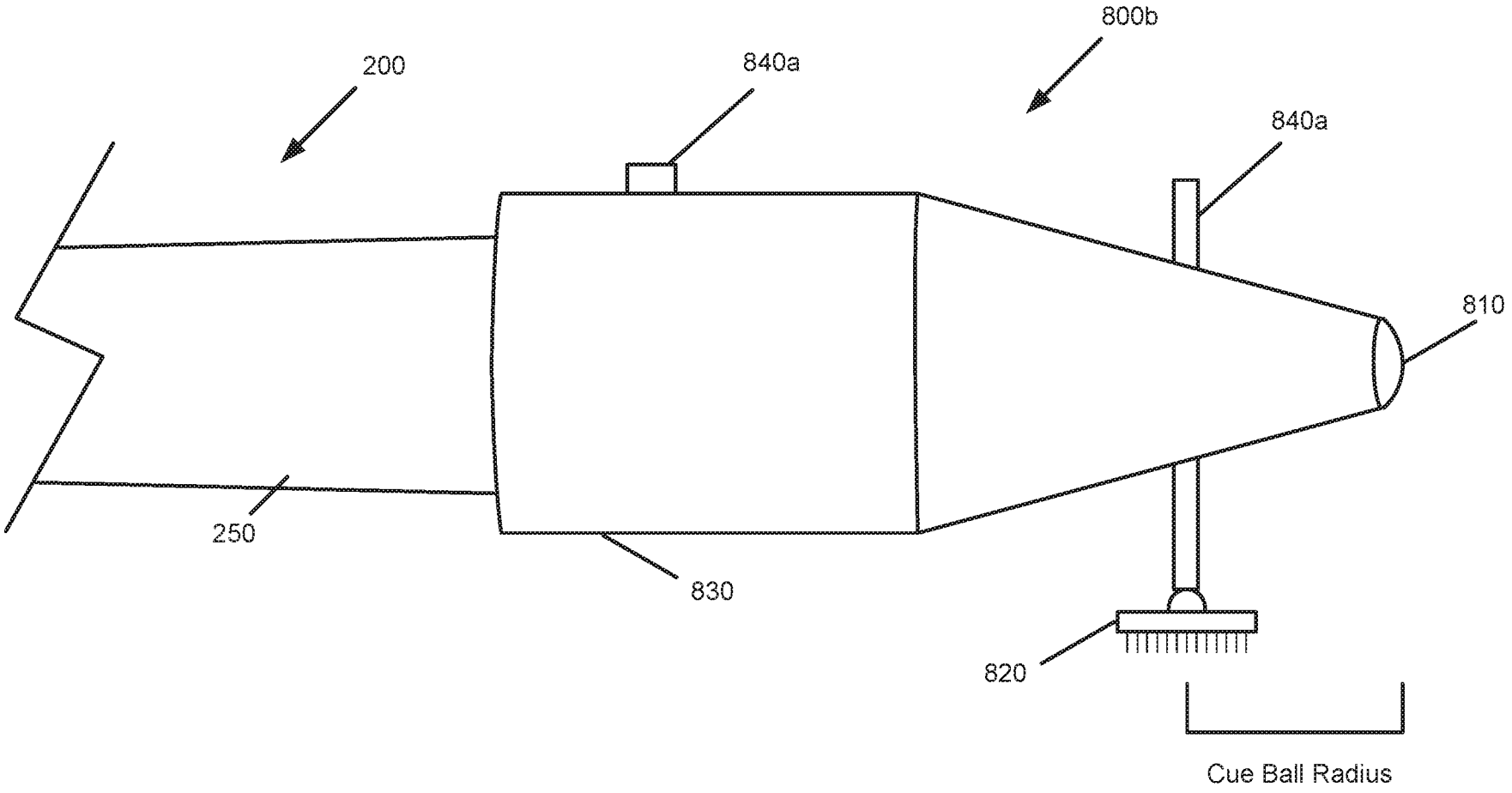

The first example tipped accessory aiming apparatus 800*a* of FIG. 8A is shown mounted to the tip end of a cue stick 200. As such, the casing 830 surrounds the tip 210 and at least some of the ferrule 230 (not shown in FIG. 8A due to the casing 830), and the shaft 220 extends from the tipped accessory aiming apparatus 800. A second example tipped accessory aiming apparatus 800*b*, is shown in FIG. 8B that is mounted to a butt end of a cue stick 200. As such, the casing 830 surrounds the bumper 240 (not shown in FIG. 8B due to the casing 830) and at least some of the grip 250, and the shaft 220 extends from the tipped accessory aiming apparatus 800.

Similarly to the first example tipped accessory aiming apparatus 800*a*, the second example tipped accessory aiming apparatus 800*b* shown in FIG. 8B includes an accessory tip 810, an accessory pivot 820 mounted one cue ball radius from the accessory tip 810 on the casing 830 of the tipped accessory aiming apparatus 800, a first sight 840*a*, and a second sight 840*b*.

It will be recognized that due to the relative sizes of a cue stick 200 at its tip end and its butt end, a tipped accessory aiming apparatus 800 intended for mounting to a butt end will have a larger cross-section for its casing 830 than a tipped accessory aiming apparatus 800 intended for mounting to a tip end and the casing 830 for either intended mounting will be larger in cross-sectional area than the cue 200 to which it is mounted. Therefore, to ensure that the cross-sectional size of the accessory tip 810 will be same as a tip 210 for a cue stick 200, the casing 830 includes a tapered section that extends to the accessory tip 810. As will be appreciated, just as tips 210 may come in various curvatures (e.g., "nickel" and "dime" tip radii) and in various hardnesses, so too can the accessory tip 810, and a tipped accessory aiming apparatus 800 with an accessory tip 810 of a given curvature and/or hardness may be used with a cue stick 200 having a tip 210 with the same or a different curvature and/or hardness.

FIG. 8C-F illustrate cutaway views of several example tipped accessory aiming apparatuses 800 that highlight various features and options for a tipped accessory aiming apparatus 800. Each of the tipped accessory aiming apparatuses 800*c-f* are illustrated to show the accessory tip 810 mounted at the tip-ward end of the casing 830, an accessory pivot 820 mounted on/to the casing 830 substantially one ball radius from the tip-ward end, the casing 830, sights 840, a casing cavity 850 opening on a stick-ward end of the casing 830, and a centering cavity 860, as well as several options for use in a tipped accessory aiming apparatus 800.

The casing cavity 850 is defined in the casing 830 and is adapted to accept either the tip-end or the butt-end of a cue stick 200. The casing cavity 850 opens at a stick-ward end of the tipped accessory aiming apparatus 800 to accept the cue stick 200, and is closed at a tip-ward or ball-ward end. Several options for securing the cue stick 200 in the casing cavity 850 are discussed in greater detail in relation to the individual FIGS. 8C-F.

At the tip-ward end (relative to the accessory tip 810) of the casing cavity 850, a centering cavity 860 is defined in the casing 830. The centering cavity 860 receives the distal end of the cue stick 200 inserted into the casing cavity 850 (e.g., the tip 210 or the bumper 240) and guides insertion of the cue stick 200 to thereby concentrically align the tipped aiming accessory apparatus 800 and the cue stick 200 and serves as a stop against which the tip 210 rests when fully inserted. In various aspects, the centering cavity 860 is a conical cavity that guides the distal end (and thereby the cue stick 200) into alignment. Similarly, in some aspects, the centering cavity 860 is shaped to accept the tip 210 or bumper 240, with a substantially hemi-spherical shape that may be partially combined with a conical shape. In yet other aspects, the centering cavity 860 is a continuation of the casing cavity 850 that terminates at a flat face. When the tip 210 of the cue stick 200 is fully and properly inserted, the centering cavity 860 provides continuity between the tip 210 and the accessory tip 810 through the casing 830 so that any force applied to the cue stick 200 by the player is evenly transferred to the tipped accessory aiming apparatus 800 and the cue ball 120*a* with as little mechanical loss as possible.

As the player uses the cue stick 200 with the mounted tipped accessory aiming apparatus 800 to strike the cue ball 120*a*, a cue stick 200 that is not well secured in the casing cavity 850 may "jam" into the casing 830 if a proper stop within the casing cavity 850 is not provided, and cause difficulties in removing the tipped accessory aiming apparatus 800 from the cue stick 200 or structural harm to the cue stick 200 and/or the tipped accessory aiming apparatus 800. Therefore, the cue stick 200 should be held securely in place within the casing cavity 850 and with the tip 210 making solid contact at a stop within the casing cavity 850 before striking the cue ball 120*a*. Various methods may be used to secure the cue stick 200, including, friction within the casing cavity 850, adjustable fasteners 870*a-b* (collectively, adjustable fasteners 870) that extend into the casing cavity 850 to engage a cue stick 200 inserted therein, and by compressing the casing cavity 850 to reduce its cross-sectional area and thereby engage the inserted cue stick 200. Additionally, the size and shape of the casing cavity 850 (and the centering cavity 860) are adapted to help secure and align the cue stick 200 so that the cue stick 200 does not jam or misalign further within the casing 830 when striking a cue ball 120*a* and that force applied to the cue stick 200 by the player is evenly transferred to the tipped accessory aiming apparatus 800 and the cue ball 120*a* with as little mechanical loss as possible.

Figure 8C:
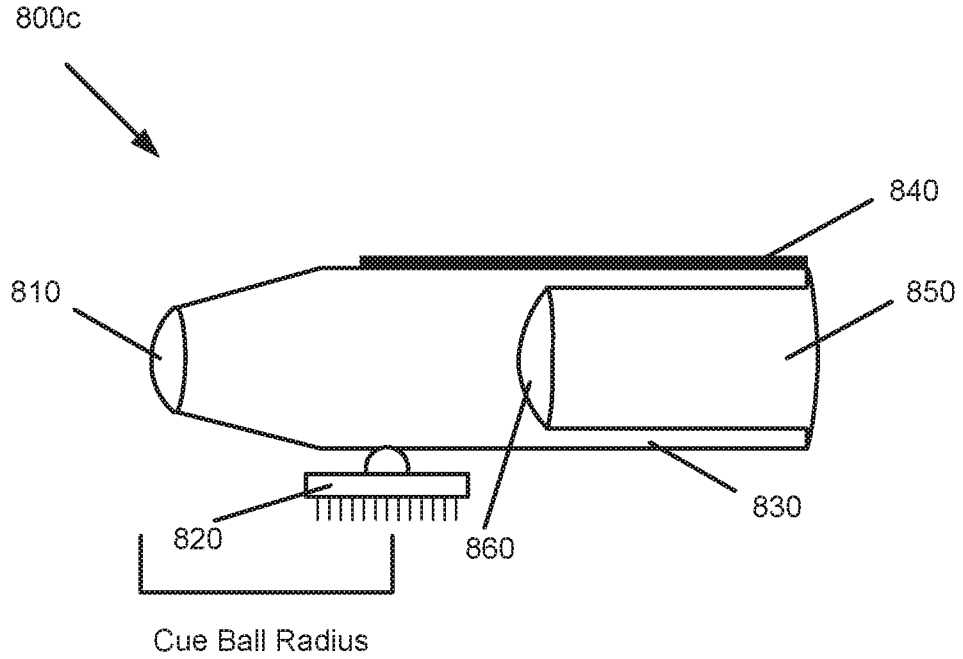

FIG. 8C illustrates a third example tipped accessory aiming apparatus 800*c* that secures the cue stick 200 with friction within the casing cavity 850. In aspects that use friction to secure the cue stick 200 within the casing cavity 200, the cross-sectional shape and area of the casing cavity 850 are adapted such that the ferrule 230 will make physical contact with the surfaces of the casing 830 that define the casing cavity 850. In various aspects, a compressible material (e.g., a leather, a textile, a rubber) is applied to some or all of the surfaces of the casing 830 that define the casing cavity 850 to ensure a snug connection between the tipped accessory aiming apparatus 800 and the cue stick 200. For example, a rubber gasket of a smaller diameter than the opening may be placed at the opening, or a textile cushion may be added to the walls of the casing cavity 850 to secure the cue stick 200 therein. In other aspects, the casing cavity 850 includes an inward taper in its cross-sectional area to engage the cue stick 200 more securely deeper within the casing cavity 850 and/or to act as a stop or catch when the larger-diameter shaft 220 is inserted into the casing cavity 850. The cross-sectional area of the casing 830, when using friction to secure the cue stick 200, is therefore sized substantially equal to the cross-sectional area of the cue stick 200, which may result in a slightly larger cross-sectional area for an incompressible casing 830 or a slightly smaller cross-sectional area for a compressible casing 830 (e.g., up to ±20% difference).

Figure 8D:
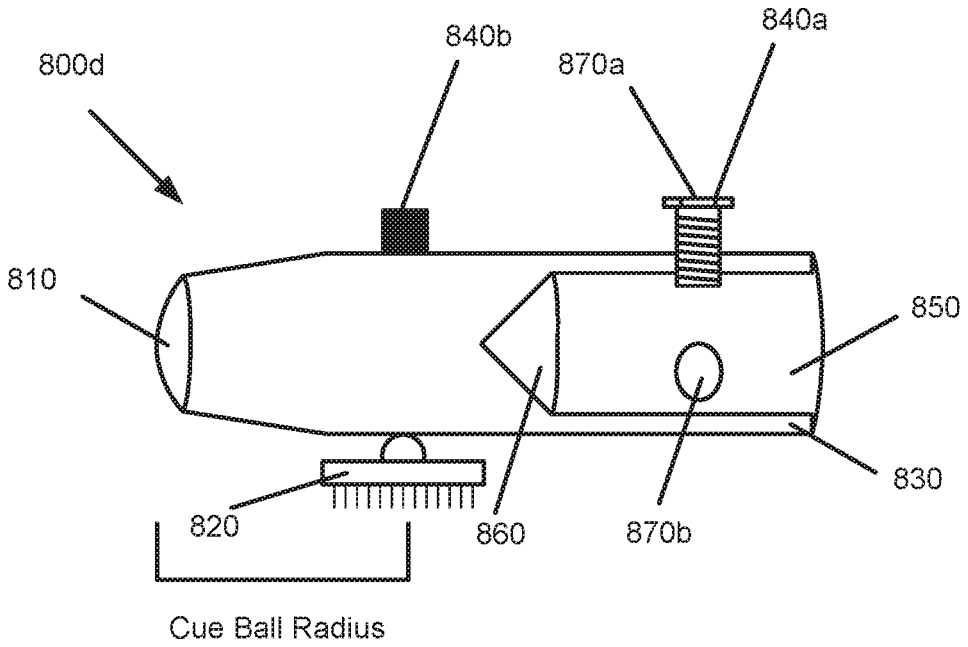

FIG. 8D illustrates a fourth example tipped accessory aiming apparatus 800*d* that secures the cue stick 200 with adjustable fasteners 870. As will be appreciated, a tipped accessory aiming apparatus using adjustable fasteners 870 may accept and secure cue sticks 200 having different cross-sectional radii within their casing cavities 850 by adjusting how far the adjustable fasteners 870 protrude into the casing cavity.

Although shown with a first adjustable fastener 870*a*, and a second adjustable fastener 870*b* that are located 120° apart on the radius of the casing cavity 850, a third adjustable fastener (not shown due to cutaway) is also used in the fourth example tipped accessory aiming apparatus 800*d* that is located 120° apart from both the first adjustable fastener 870*a* and the second adjustable fastener 870*b*. Although three screw-type adjustable fasteners 870 are used in the illustrated example in FIG. 8D, that can screw in and out of various depths into the casing cavity 850, one of ordinary skill in the art will appreciate that more or fewer adjustable fasteners 870 and of different types may be used in other aspects. For example, one or more aperture-type adjustable fasteners 870 (similar to the pupil of a camera) may be used with a control interface protruding from the casing 830 to control an aperture diameter of the aperture-type adjustable fastener 870 and thereby engage portions of cue sticks 200 having various diameters.

In various aspects, one or more of the adjustable fasteners 870 or their control interfaces that protrude from the casing 830 may also be used as a sight 840. For example, a first adjustable fastener 870*a* may be located in-line with a second sight 840*b* to enable a player to use the first adjustable fastener 870*a* as the first sight 840*a*.

Figure 8E:
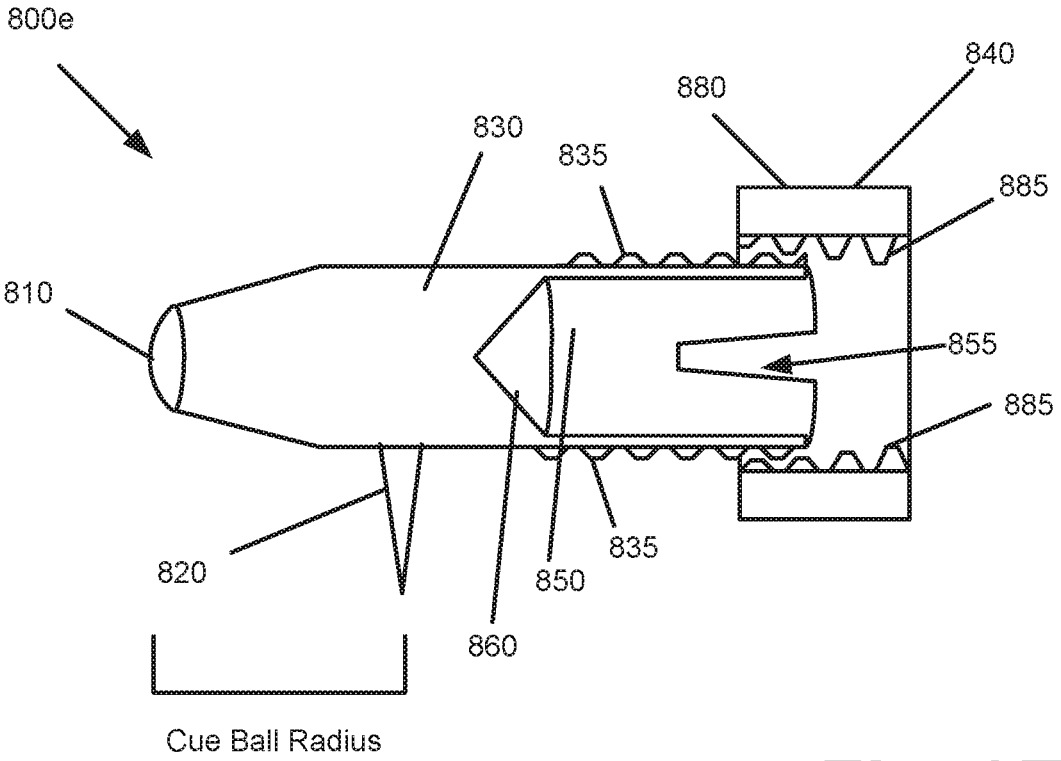
Figure 8F:
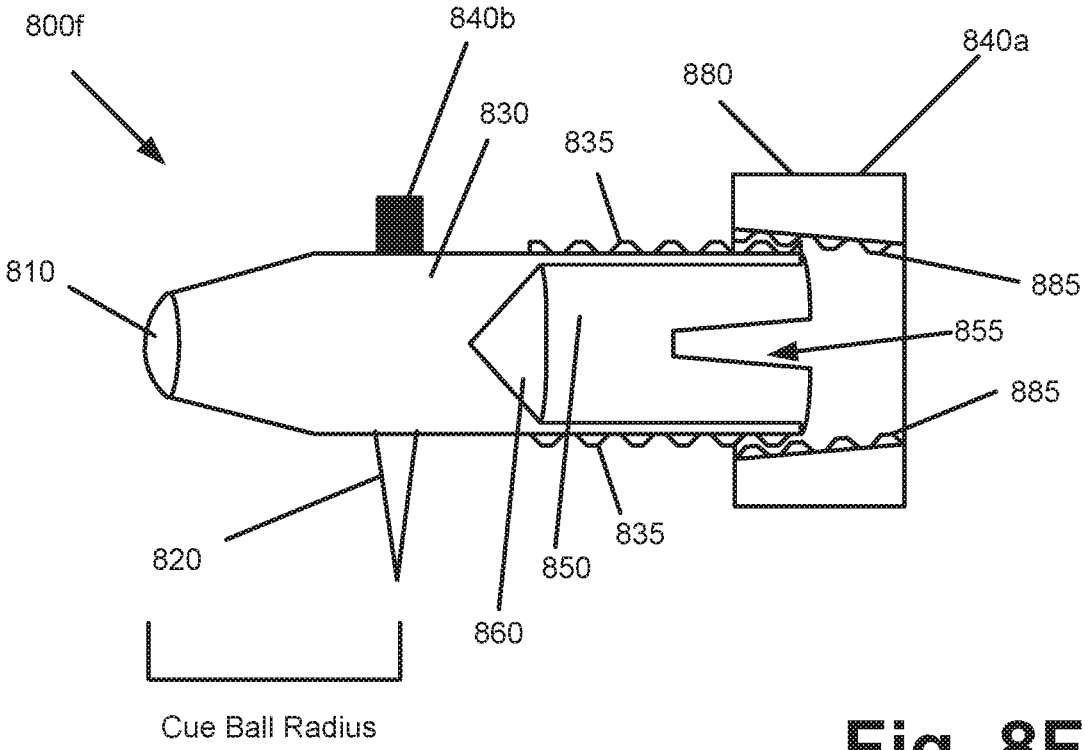

FIGS. 8E and 8F respectively illustrate a fifth example tipped accessory aiming apparatus 800*e* and a sixth example tipped accessory aiming apparatus 800*f* that secure the cue stick 200 by using a gland nut 880. The gland nut 880 includes nut threads 885 that interact with casing threads 835 positioned on the outer surface of the casing 830 at the stick-ward end so that the gland nut 880 may be screwed onto and off of the casing 830. As will be appreciated, the gland nut 880 is shaped to constrict the cross-sectional area of the casing cavity 850 when screwed onto the casing 830, and relax/expand the cross-sectional areas of the casing cavity 850 when screwed off of the casing 830. To enable the casing cavity 850 to expand and contract without damage to the casing 830, one or more compression slits 855 are defined in the casing 830 that provide free space for the casing 830 to contract into when the gland nut 880 is screwed onto the casing 830.

In various aspects, the gland nut 880 includes a sight 840 or acts as a sight 840 itself. In various aspects, the gland nut 880 has a hexagonal outer shape or a round outer shape, but other shapes are also envisioned. The outer surface of the gland nut 880 optionally includes knurling or other surface texture features that improve the grip of a player when handling the gland nut 880. In some aspects, jewels are set into the outer surface of the gland nut 880, which may act as ornamental features, sights 840, and grip-improving texture features.

To ensure that the gland nut 880 compresses the casing 830 when screwed on, the threadings of either the gland nut 880 or the casing 830 may increase in profile as the threading progresses, as is shown in FIG. 8E for the nut threads 885, although a profile increase may be used in the casing threads 835 in addition to or instead of the nut threads 885. In another example, illustrated in FIG. 8F, the profile of the threadings may remain the same, but the pitch at which they are mounted in the gland nut 880 or to the casing 830 may increase over the course of the threadings to thereby ensure that the gland nut 880 compresses the casing 830 when screwed on.

Figure 8G:
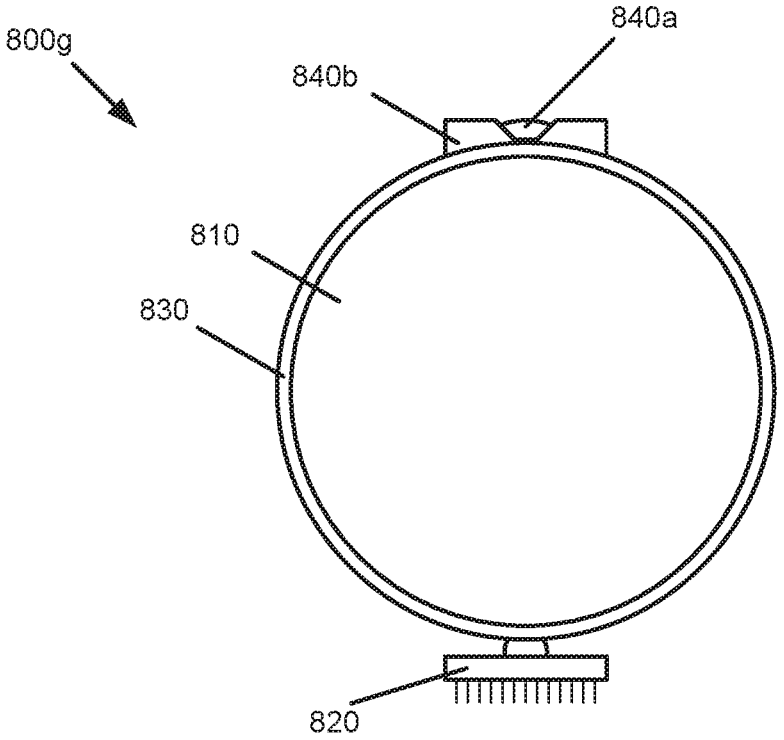
Figure 8H:
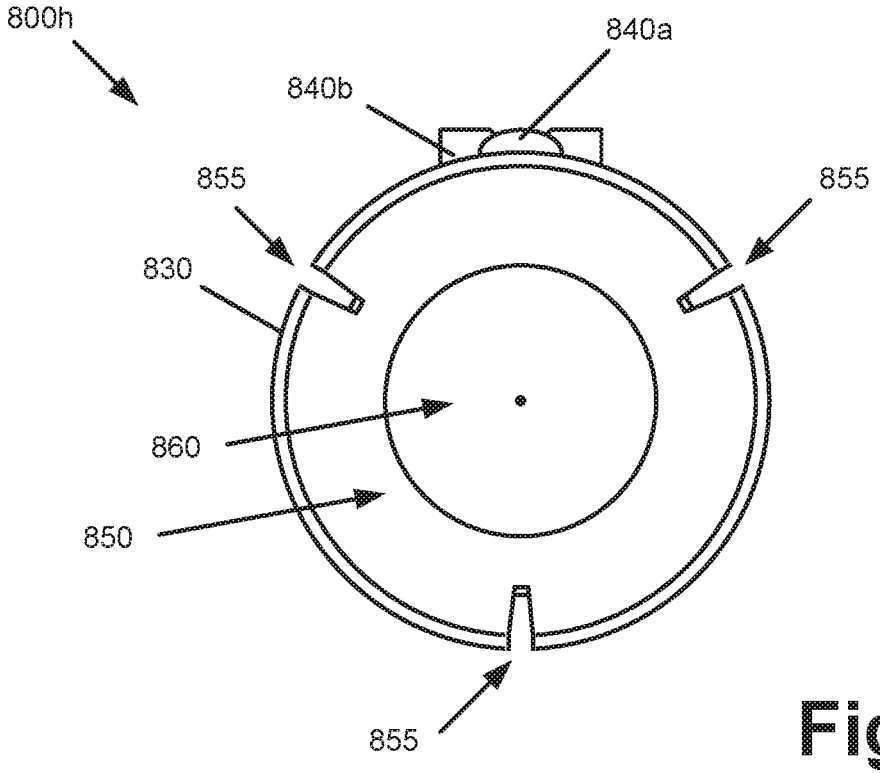

FIG. 8G illustrates a face view of the tip-ward side of a seventh example tipped accessory aiming apparatus 800*g*. FIG. 8H illustrates a face view of the stick-ward side of an eighth example tipped accessory aiming apparatus 800*h*. The various features of a tipped accessory aiming apparatus 800 that are visible include the accessory tip 810, the accessory pivot 820, the casing 830, a first sight 840*a*, a second sight 840*b*, the casing cavity 850, three compression slits 855, and the centering cavity 860. In various aspects, each of the sights 840 may be a raised bead sight, a raised bar sight, a paint sight line, an open sight, a closed sight, and may be made of various materials, including, but not limited to: gemstones, crystals, fiber optic cables, carbon fiber, ceramics, wood, bone, antler, plastic, and metal.

Figure 9A:
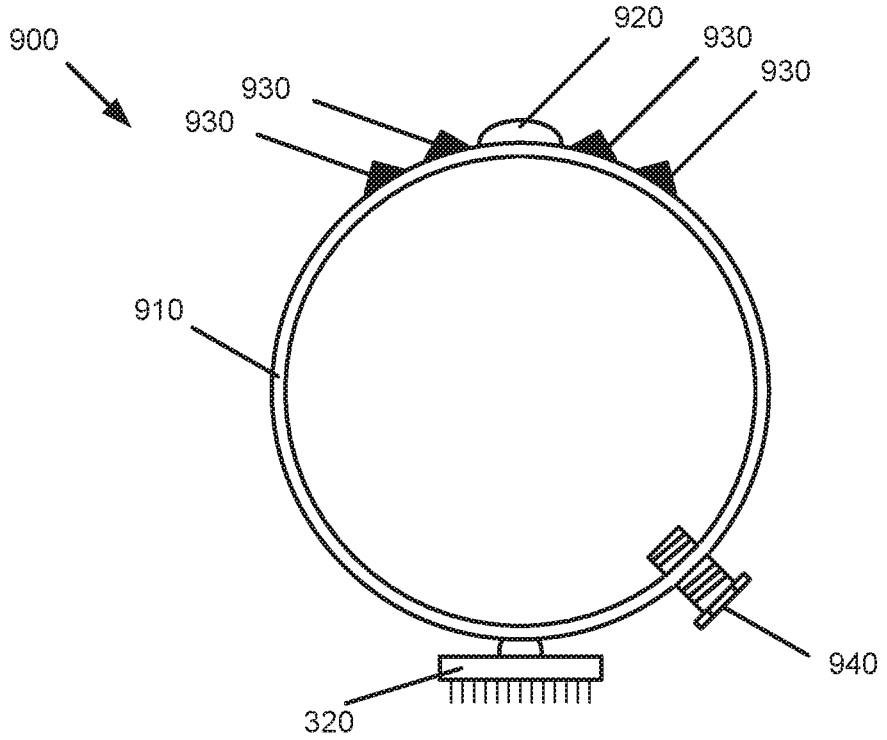
FIGS. 9A-B illustrate a ring accessory aiming apparatus.
Figure 9B:
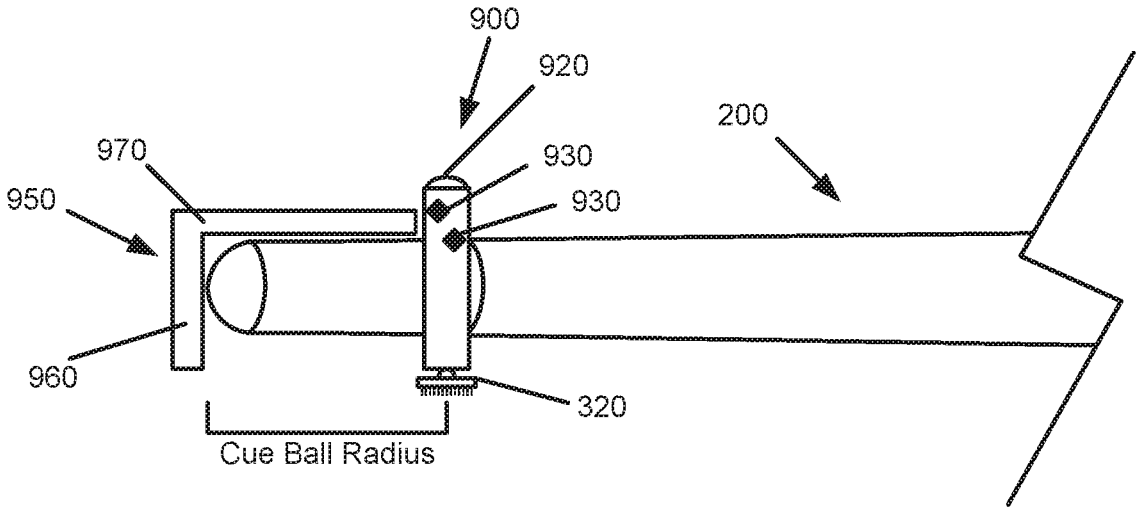

FIGS. 9A-B illustrate examples of a ring accessory aiming apparatus 900. A ring accessory aiming apparatus 900 is a separate device that may be added to and removed from a cue stick 200 at the player's discretion, and allows for any cue stick 200 to be used in conjunction with the teachings of the present disclosure. As will be appreciated, a ring accessory aiming apparatus 900 may also be used with a different cue stick 200 than the cue stick 200 used by the player to strike the cue ball 120*a*, or with a different stick or rod than a cue stick 200, such as the shaft of a mechanical bridge. The ring accessory aiming apparatus 900 includes any or all of the components of the aiming apparatus 300 discussed in FIGS. 3A-B and FIGS. 4A-I and is configured to define a through-hole in an inner surface of the ring accessory aiming apparatus 900, through which the tip 210 of the cue stick 200 protrudes when mounted to a cue stick 200. A ring accessory aiming apparatus 900 is designed to be placed on the ferrule 230 or shaft 220 of the cue stick 200 and remain thereon while the player uses the cue stick 200.

FIG. 9A illustrates a facing view of an example ring accessory aiming apparatus 900. The body 910 of the ring accessory aiming apparatus 900 may be made of any material, including, but not limited to: metals (e.g., titanium, steel, gold, silver, platinum), plastics, ceramics, carbon fiber, crystals, glass, bone, and antler. The body 910 has two faces (one of which is shown in FIG. 9A) and a width of the body 910 is defined as the distance between these two faces. In various aspects the faces may be flat or beveled, and may also be smooth or patterned.

The body 910 has an inner surface that defines a through-hole into which the cue stick 200 is inserted, and may include mountings or settings on an outer surface for a primary focus 920 and optionally, one or more secondary focuses 930. The primary focus 920 and the (optional) secondary focuses 930 act as sights by which player may gauge a shot and the alignment of the cue stick 200 with the object ball 120*b* and the cue ball 120*a*. In various aspects, the primary focus 920 (and any optional focuses 930) is made of materials that include, but are not limited to: gemstones, crystals, fiber optic cables, carbon fiber, ceramics, wood, bone, antler, plastic, and metals. A pivot 320 is mounted to the outer surface of the ring accessory aiming apparatus 900 (opposite to the primary focus 920) and may be of any of the types of pivot discussed in relation to in FIGS. 4A-I.

Additionally, in some aspects, a ring accessory aiming apparatus 900 optionally includes a securing fastener 940 that protrudes into the through-hole to engage the cue stick 200, by which the player may adjust to secure the cue stick 200 to the inner surface of body 910, such as one or more tightening screws, a clamp, a screw-on pivot 320, or the like.

FIG. 9B illustrates an example ring accessory aiming apparatus 900 mounted on a cue stick 200 and positioned with the center of its pivot 320 one cue ball radius away from the tip 210 of the cue stick 200 via a mounting positioner 950. The mounting positioner 950 includes a tip arm 960 that is held flush to the tip 210 when positioning the ring accessory aiming apparatus 900, and a positioning arm 970, connected to the tip arm 960, which extends perpendicularly from the tip arm 210 that is to be held flush to the tip 210 of the cue stick 200. A player is then able to slide the ring accessory aiming apparatus 900 onto the ferrule 230 of the cue stick 200 and place the ring accessory aiming apparatus 900 so that the center of the pivot 320 is one cue ball radius away from the tip 210 by aligning the mounting positioner 950 with the tip (at the tip arm 960) and the forward face of the ring accessory aiming apparatus 900 (at the positioning arm 970) as shown in FIG. 9B.

As will be appreciated, a length of the tip arm 970 of the mounting positioner 950 is dependent not only on the cue ball radius for the selected cue sport, but also the predetermined distance at which the center of the pivot 320 lies from a face of the body 910 of the ring accessory aiming apparatus 900 with which it is used. In various aspects, where the pivot 320 is mounted to the outer surface of the body 910 at half the width of the body 910 (i.e., equidistant from a first face and a second face), the length of the tip arm 970 is one cue ball radius less half the width of the body 910 ($l_{tip_arm}=r_{cue_ball}-w_{ring_body}\div 2$). In other aspects, a given ring accessory aiming apparatus 900 may be used in multiple cue sports with cue balls 120*a* of different radii by offsetting the predetermined distance of the pivot 320 relative to the first and second faces of the body 910. For example, American pool uses a cue ball 120*a* of 28.575 mm in radius and Snooker uses a cue ball 120*a* of 26.25 mm in radius. Continuing the example, a tip arm 970 having a length of 20 mm can be used with a ring accessory aiming apparatus 900 having a width of 14.825 mm where the pivot is mounted 8.575 mm from a first face (for American pool) and mounted 6.25 mm from a second face (for Snooker). As will be appreciated, the foregoing is just one non-limiting example of a paired mounting positioner 950 and ring accessory aiming apparatus 900 having an offset pivot 320; other lengths, widths, and offsets for use in other combinations of cue sports are contemplated by the present disclosure.

In various aspects, a mounting positioner 950 is provided with a tip arm 960 and a positioning arm 970 that are static to one another, while in other aspects, the tip arm 960 and positioning arm 970 are mounted to one another at a hinge; allowing a dynamic joint so that the mounting positioner 950 may be collapsed (e.g., for easier transport). For example, a tip arm 960 may define a cavity in a central portion therein into which a positioning arm 970 mounted on a hinge may collapse into for storage, and rotate out of to extend perpendicularly from the tip arm 960 when in use. In another example, a hinged tip arm 960 and positioning arm 970 pair may be aligned in parallel adjacent to one another in storage, but rotate 90° to extend perpendicularly from one another.

In various aspects, one or more mounting positioners 950 are included in a kit with one or more ring accessory aiming apparatuses 900. For example, a first mounting positioner 950 having a positioning arm 970 of a first length as measured from a tip-face of its tip arm 960 (e.g., for the radius of an American-sized cue ball 120*a* in combination with the ring accessory aiming apparatuses 900) and a second mounting positioner 950 having a positioning arm 970 of a second length as measured from a tip-face of its tip arm 960 (e.g., for the radius of a Snooker-sized cue ball 120*a* in combination with the ring accessory aiming apparatuses 900) may be included with one ring accessory aiming apparatus 900 as a kit for ghost ball aiming in multiple cue sports. In another example, a first ring accessory aiming apparatuses 900 with a first inner diameter and a second ring accessory aiming apparatuses 900 with a second inner diameter are included with one mounting positioner 950 as a kit for ghost ball aiming in one cue sport but with various diameter cue sticks 200. In a further example, two ring accessory aiming apparatuses 900 with different types of pivots 320 are included as a kit. As will be appreciated, more or fewer ring accessory aiming apparatuses 900 and/or mounting positioners 950 with various inner diameters of their bodies 910, lengths of their positioning arms 970, and relative positions of their pivots 320 along the width of the bodies 910 may be included in kit than are outlined in the above examples.

Notwithstanding the appended claims, the disclosure may also be defined by the following numbered clauses:

Clause 1: An integrated aiming apparatus, comprising:
- a cue stick, having a tip end and a butt end, wherein the cue stick tapers from a first diameter at the butt end to a second diameter at the tip end; and
- a pivot, protruding from the cue stick within substantially one ball radius from a ballward end of the cue stick.

Clause 2: The integrated aiming apparatus of clauses 1, 3, 4, 5, 6, 7, or 8, further including an aiming platform having a stickward end connected to the cue stick, and a free end extending from the stickward end that is free when the aiming platform is engaged, the aiming platform including the pivot, wherein the ballward end of the cue stick is the free end of the aiming platform when the aiming platform is engaged.

Clause 3: The integrated aiming apparatus of clauses 1, 2, 4, 5, 6, 7, or 8, wherein the aiming platform includes at least one of:
- a mirrored surface;
- a transparent surface; and
- at least one sight line along a centerline of the aiming platform.

Clause 4: The integrated aiming apparatus of clauses 1, 2, 3, 5, 6, 7, or 8, wherein the aiming platform is selectively engagable by at least one of:
- yaw rotation of the aiming platform relative to the cue stick;
- pitch rotation of the aiming platform relative to the cue stick;
- sliding the aiming platform relative to the cue stick; and
- pitch rotation of the pivot relative to the cue stick.

Clause 5: The integrated aiming apparatus of clauses 1, 2, 3, 4, 6, 7, or 8, wherein the aiming platform when selectively disengaged is stored by at least one of:
- collapsing into a pocket defined in the cue stick; and
- resting against a shaft of the cue stick.

Clause 6: The integrated aiming apparatus of clauses 1, 2, 3, 4, 5, 7, or 8, wherein the ballward end of the cue stick is at least one of:
- the tip end of the cue stick; and
- the butt end of the cue stick.

Clause 7: The integrated aiming apparatus of clauses 1, 2, 3, 4, 5, 6, or 8, wherein the pivot comprises at least one of:
- a fixed position pivot;
- a re-positionable pivot;
- a pop-up pivot;

a telescoping pivot;
a storable pivot;
a free-rotating pivot; and
wherein a contact point of the pivot is selected from the group consisting of:
a pin-type; and
a brush-type.

Clause 8: The integrated aiming apparatus of clauses 1, 2, 3, 4, 5, 6, or 7, wherein the pivot comprises a gemstone that is cut to provide a contact point by which to contact a play surface and about which the cue stick is rotated to thereby determine an aim line between an object ball and a cue ball on the play surface.

Clause 9: An accessory aiming apparatus, comprising:
an accessory connector, configured to selectively-attach the aiming accessory to an attachment point on a cue stick; and
an aiming platform having a stickward edge connected to the accessory connector and a ballward edge extending away from the accessory connector, the aiming platform including a pivot located a predefined distance from the ballward edge of the aiming platform.

Clause 10: The accessory aiming apparatus of clauses 9, 11, 12, 13, 14, 15, 16, or 17, wherein the accessory connector comprises a ring of a diameter substantially equal to that of the cue stick at the attachment point.

Clause 11: The accessory aiming apparatus of clauses 9, 10, 12, 13, 14, 15, 16, or 17, wherein the ring is an open ring comprised of a flexible material.

Clause 12: The accessory aiming apparatus of clauses 9, 10, 11, 13, 14, 15, 16, or 17, wherein the ballward edge of the aiming platform is sized and convexly arced according to dimensions of a play ball.

Clause 13: The accessory aiming apparatus of clauses 9, 10, 11, 12, 14, 15, 16, or 17, wherein at least a portion of the aiming platform is clear.

Clause 14: The accessory aiming apparatus of clauses 9, 10, 11, 12, 13, 15, 16, or 17, wherein the aiming platform includes a mirrored surface.

Clause 15: The accessory aiming apparatus of clauses 9, 10, 11, 12, 13, 14, 16, or 17, wherein the aiming platform includes a sight line.

Clause 16: The accessory aiming apparatus of clauses 9, 10, 11, 12, 13, 14, 15, or 17, wherein the pivot is at least one of:
a pin-type pivot;
a brush-type pivot;
a pop-up pivot;
a telescoping pivot;
a storable pivot; and
a free-rotating pivot.

Clause 17: The accessory aiming apparatus of clauses 9, 10, 11, 12, 13, 14, 15, or 16, wherein the predefined distance is adjustable to match a radius of a cue ball.

Clause 18: A method for ghost ball aiming using an aiming apparatus in conjunction with a cue stick, comprising:
selecting a play ball present on a play surface as an object ball;
selecting a target at which to aim the object ball;
locating a cue ball on the play surface;
positioning the aiming apparatus and the cue stick in line with the object ball and the target;
maintaining contact with the play surface with a contact point of the aiming apparatus; and
rotating the aiming apparatus and the cue stick about the contact point to align the aiming apparatus and the cue stick with the cue ball along an aim line to a ghost ball spot on the object ball.

Clause 19: The method of clauses 18 or 20, wherein the contact point makes contact with the play surface at a distance of one ball radius from where the object ball is positioned on the play surface.

Clause 20: The method of clauses 18 or 19, further comprising:
prior to positioning the aiming apparatus and the cue stick in line with the object ball and the target: engaging the aiming apparatus with the cue stick; and
after rotating the aiming apparatus and the cue stick about the contact point to align the aiming apparatus and the cue stick with the cue ball:
removing the contact point from the play surface;
disengaging the aiming apparatus from the cue stick;
drawing the cue stick behind the cue ball along the aim line; and
striking the cue ball to make contact with the object ball at the ghost ball spot.

Clause 21: A tipped accessory aiming apparatus, comprising:
a casing, having a stick-ward end and a tip-ward end and defining a casing cavity therein that opens at the stick-ward end and extends towards the tip-ward end;
an accessory tip, mounted at the tip-ward end of the casing; and
a pivot, protruding from the casing within substantially one ball radius from the tip-ward end of the casing.

Clause 22: The tipped accessory aiming apparatus of clauses 21, 23, 24, 25, 26, 27, or 28, further including a centering cavity defined in the case at a tip-ward end of the casing cavity, wherein a volume of the centering cavity is shaped according to one of:
a cone, adapted to center a cue stick inserted into the centering cavity; and
a tip of the cue stick inserted into the centering cavity.

Clause 23: The tipped accessory aiming apparatus of claim 1, wherein the casing cavity is adapted to receive a portion of a cue stick, the portion of the cue stick being selected from one of:
a tip-ward portion of the cue stick comprising a tip and at least a portion of a ferrule; and
a butt-ward portion of the cue stick comprising at least a portion of a grip.

Clause 24: The tipped accessory aiming apparatus of clauses 21, 22, 23, 25, 26, 27, or 28, wherein the accessory tip is of a first curvature that is different from a second curvature defined by a tip of a cue stick used with the tipped accessory aiming apparatus.

Clause 25: The tipped accessory aiming apparatus of clauses 21, 22, 23, 24, 26, 27, or 28, wherein the casing cavity is adapted to secure a cue stick inserted therein by one of:
friction, wherein the casing cavity has a cross-sectional area substantially similar to a cross-sectional area of the cue stick;
adjustable fasteners, wherein the adjustable fasteners adjustably extend into the casing cavity to contact and secure the cue stick therein; or
a gland nut, wherein casing threads are defined on an outer surface of the casing to engage the gland nut and thereby compress the casing cavity.

Clause 26: The tipped accessory aiming apparatus of clauses 21, 22, 23, 24, 25, 27, or 28, wherein the casing further defines a compression slit at the stick-ward end.

Clause 27: The integrated aiming apparatus of clauses 21, 22, 23, 24, 25, 26, or 28, wherein the pivot comprises at least one of:
a fixed position pivot;

a re-positionable pivot;
a pop-up pivot;
a telescoping pivot;
a storable pivot;
a free-rotating pivot; and
wherein a contact point of the pivot is selected from the group consisting of:
a pin-type; and
a brush-type.

Clause 28: The tipped accessory aiming apparatus of clauses 21, 22, 23, 24, 25, 26, or 27, wherein an outer surface of the casing includes a sight, wherein the sight comprises at least one of:
a bar sight;
a paint sight line;
an open sight;
a closed sight; or
a bead sight; and
wherein the sight is made of at least one of:
a gemstone;
fiber optic cable;
wood;
bone;
antler;
plastic; or
metal.

Clause 29: A kit for enabling ghost ball aiming using an aiming apparatus in conjunction with a cue stick, comprising:
a ring accessory aiming apparatus, comprising:
a body, having an outer surface and an inner surface, the inner surface defining a through-hole that is sized to accept a tip-end of a cue stick, the through-hole extending along a width of the body from a first face to a second face; and
a pivot, mounted to the outer surface of the body a predetermined distance relative to the first face; and
a mounting positioner, comprising:
a tip arm, having a tip face; and
a positioning arm, connected to and extending perpendicularly from the tip arm, wherein the positioning arm extends a predetermined length from the tip face, wherein the predetermined length and the predetermined distance equal one cue ball radius.

Clause 30: The kit of clauses 29, 31, 32, 33, 34, 35, 36, or 37, further comprising:
a second ring accessory aiming apparatus, comprising:
a second body, having a second outer surface and a second inner surface, the second inner surface defining a second through-hole that is sized to accept a second tip-end of a second cue stick, wherein the second through-hole is a different size than the first through-hole; and
a second pivot, mounted to the second outer surface of the second body.

Clause 31: The kit of clauses 29, 30, 32, 33, 34, 35, 36, or 37, further comprising:
a second mounting positioner, comprising:
a second tip arm, having a second tip face; and
a second positioning arm, connected to and extending perpendicularly from the second tip arm, wherein the second positioning arm extends a second predetermined length from the second tip face, and wherein the second predetermined length and the predetermined distance equal one different cue ball radius.

Clause 32: The kit of clauses 29, 30, 31, 33, 34, 35, 36, or 37, wherein the ring accessory aiming apparatus further comprises:
a primary focus, mounted to the outer surface opposite to the pivot.

Clause 33: The kit of clauses 29, 30, 31, 32, 34, 35, 36, or 37, wherein the ring accessory aiming apparatus further comprises:
a secondary focus, mounted to the outer surface.

Clause 34: The kit of clauses 29, 30, 31, 32, 33, 35, 36, or 37, wherein the ring accessory aiming apparatus further comprises:
a securing fastener, mounted in the body, extending into the through-hole to engage the cue stick, operable to selectively adjust how far the securing fastener protrudes into the through-hole.

Clause 35: The kit of clauses 29, 30, 31, 32, 33, 34, 36, or 37, wherein the positioning arm, connects to the tip arm at a hinge, wherein the hinge enables the positioning arm to extend perpendicularly from the tip arm and to collapse parallel with the tip arm.

Clause 36: The kit of clauses 29, 30, 31, 32, 33, 34, 35, or 37, wherein the pivot is one of:
a pin-type pivot;
a brush-type pivot;
a pop-up pivot;
a telescoping pivot;
a storable pivot; and
a free-rotating pivot.

Clause 37: The kit of clauses 29, 30, 31, 32, 33, 34, 35, or 36, further comprising:
a third ring accessory aiming apparatus, comprising:
a third body, having a third outer surface and a third inner surface, the third inner surface defining a third through-hole that is sized to accept the tip-end of the cue stick; and
a third pivot, mounted to the third outer surface of the third body, wherein the third pivot, relative to the pivot, is a different one of:
the pin-type pivot;
the brush-type pivot;
the pop-up pivot;
the telescoping pivot;
the storable pivot; and
the free-rotating pivot.

Clause 38: A method for ghost ball aiming using an aiming apparatus in conjunction with a cue stick, comprising:
selecting a play ball present on a play surface as an object ball;
selecting a target at which to aim the object ball;
locating a cue ball on the play surface;
positioning the aiming apparatus and the cue stick in line with the object ball and the target, wherein a tip of the cue stick is located at an edge of the object ball;
maintaining contact with the play surface with a contact point of the aiming apparatus; and
rotating the aiming apparatus and the cue stick about the contact point to align the aiming apparatus and the cue stick with the cue ball along an aim line to a ghost ball spot on the object ball.

Clause 39: The method of clauses 38 or 40, further comprising:
prior to positioning the aiming apparatus and the cue stick in line with the object ball and the target: engaging the aiming apparatus with the cue stick, such that the aiming apparatus is concentrically aligned with the cue stick, and wherein the aiming apparatus includes an accessory tip adapted for contacting the cue ball; and
after rotating the aiming apparatus and the cue stick about the contact point to align the aiming apparatus and the cue stick with the cue ball:

removing the contact point from the play surface;

drawing the cue stick behind the cue ball along the aim line; and striking the cue ball with the accessory tip to make contact with the object ball at the ghost ball spot.

Clause 40: The method of clauses 38 or 39, further comprising:

prior to positioning the aiming apparatus and the cue stick in line with the object ball and the target: engaging the aiming apparatus with the cue stick, wherein the aiming apparatus comprises a ring body, and wherein engaging the aiming apparatus further comprises sliding the ring body onto a ferrule of the cue stick, such that the ring body is substantially one cue ball radius away from the tip of the cue stick; and after rotating the aiming apparatus and the cue stick about the contact point to align the aiming apparatus and the cue stick with the cue ball:

removing the contact point from the play surface;

drawing the cue stick behind the cue ball along the aim line; and while the ring body is engaged with the cue stick, striking the cue ball with the tip of the cue stick to make contact with the object ball at the ghost ball spot.

The foregoing has been provided as a non-limiting set of examples of the inventive concept as claimed. The example illustrations and the discussion thereof are considered sufficient to convey to one of ordinary skill in that art the ability to make and use the best mode and to implement variations, combinations, and modifications of the provided examples to meet various use cases. Various features described in relation to the structural and methodological underpinnings of the present disclosure are intended to be included, excluded, and combined at the practitioner's discretion to produce examples with desired sets of features and functionalities without departing from the broader scope of the inventive concept of the present disclosure.

What is claimed is:

1. A tipped accessory aiming apparatus, comprising:

a casing, having a stick-ward end and a tip-ward end and defining a casing cavity therein that opens at the stick-ward end and extends towards the tip-ward end;

a centering cavity defined in the casing at a tip-ward end of the casing cavity, the centering cavity configured to guide insertion of a distal end of a cue stick into the casing cavity and concentrically align the tipped aiming accessory apparatus and the cue stick such that the tipped accessory aiming apparatus is a separate device from the cue stick;

an accessory tip, mounted at the tip-ward end of the casing; and a pivot, mounted between the tip-ward end and the stick-ward end of the casing, the pivot extending orthogonally from the casing and fixedly positioned relative to the casing, the pivot being configured to maintain contact with a play surface during a rotation of the cue stick relative to the play surface.

2. The tipped accessory aiming apparatus of claim 1, wherein the distal end of the cue stick is selected from one of:

a tip-ward portion of the cue stick comprising a tip and at least a portion of a ferrule; and a butt-ward portion of the cue stick comprising at least a portion of a grip.

3. The tipped accessory aiming apparatus of claim 1, wherein the casing cavity is adapted to secure a cue stick inserted therein by one of:

friction, wherein the casing cavity has a cross-sectional area substantially similar to a cross-sectional area of the distal end of the cue stick;

adjustable fasteners, wherein the adjustable fasteners adjustably extend into the casing cavity to contact and secure the distal end of the cue stick therein; or a gland nut, wherein casing threads are defined on an outer surface of the casing to engage the gland nut and thereby compress the casing cavity.

4. The tipped accessory aiming apparatus of claim 1, wherein the casing further defines a compression slit at the stick-ward end.

5. The tipped accessory aiming apparatus of claim 1, wherein an outer surface of the casing includes a sight, wherein the sight comprises at least one of:

a bar sight;

a paint sight line;

an open sight;

a closed sight; or a bead sight; and wherein the sight is made of at least one of:

a gemstone;

fiber optic cable;

wood;

bone;

antler;

plastic; or metal.

6. The tipped accessory aiming apparatus of claim 1, wherein the casing cavity secures the tipped accessory aiming apparatus to the cue stick with friction.

7. The tipped accessory aiming apparatus of claim 1, wherein the casing cavity includes a rubber gasket to provide a connection between the tipped accessory aiming apparatus and the distal end of the cue stick.

8. The tipped accessory aiming apparatus of claim 1, wherein the casing cavity includes an inward taper configured to engage the distal end of the cue stick.

9. The tipped accessory aiming apparatus of claim 1, wherein a distance between the pivot and the accessory tip is fixed.

10. An accessory aiming apparatus, comprising:

an accessory connector configured to selectively-attach the accessory aiming apparatus to an attachment point on a cue stick, the accessory connector having a hollow body extending between a stickward end and a ballward end and being configured to guide insertion of a distal end of a cue stick into the accessory connector such that the accessory aiming apparatus is a separate device from the cue stick; and an aiming platform having a stickward edge connected to the accessory connector and a ballward edge extending beyond the ballward end of the accessory connector, the aiming platform including a pivot mounted between the stickward edge and the ballward edge of the aiming platform, the pivot extending orthogonally from the aiming platform and fixedly positioned relative to the aiming platform, and being configured to maintain contact with a play surface during a rotation of the cue stick relative to the play surface.

11. The accessory aiming apparatus of claim 10, wherein the hollow body has a diameter substantially equal to that of the cue stick at the attachment point.

12. The accessory aiming apparatus of claim 11, wherein the hollow body is an open ring comprised of a flexible material.

13. The accessory aiming apparatus of claim 10, wherein the ballward edge of the aiming platform is convexly arched.

14. The accessory aiming apparatus of claim 10, wherein at least a portion of the aiming platform is transparent.

15. The accessory aiming apparatus of claim 10, wherein the aiming platform includes a mirrored surface.

16. The accessory aiming apparatus of claim 10, wherein the aiming platform includes a sight line.

* * * * *